US006050672A

United States Patent [19]

Matsuhashi

[11] Patent Number: 6,050,672

[45] Date of Patent: Apr. 18, 2000

[54] CARTRIDGE FOR INK JET PRINTER AND INK JET PRINTER

[75] Inventor: Kunihiko Matsuhashi, Nagano, Japan

[73] Assignee: Seiko Epson Corporation, Tokyo, Japan

[21] Appl. No.: 08/809,454

[22] PCT Filed: Jul. 24, 1996

[86] PCT No.: PCT/JP96/02068

§ 371 Date: Aug. 14, 1997

§ 102(e) Date: Aug. 14, 1997

[87] PCT Pub. No.: WO97/06010

PCT Pub. Date: Feb. 20, 1997

[30] Foreign Application Priority Data

Aug. 10, 1995 [JP] Japan ..... 7-204534
Sep. 25, 1995 [JP] Japan ..... 7-246385

[51] Int. Cl.[7] ..... B41J 2/165

[52] U.S. Cl. ..... 347/36; 347/86

[58] Field of Search ..... 347/36, 104, 101, 347/108, 86; 346/136

[56] References Cited

U.S. PATENT DOCUMENTS

| | | | |
|---|---|---|---|
| 4,333,087 | 6/1982 | Yamaguti | 347/93 |
| 4,437,105 | 3/1984 | Mrazek et al. | 347/29 |
| 4,737,860 | 4/1988 | Ono et al. | 358/298 |
| 4,747,619 | 5/1988 | Sager | 462/67 |
| 4,940,690 | 7/1990 | Skees | 503/206 |
| 4,965,596 | 10/1990 | Nagoshi et al. | 347/36 |
| 5,157,421 | 10/1992 | Kitahara | 347/86 |
| 5,172,140 | 12/1992 | Hirabayashi et al. | 347/36 |
| 5,222,818 | 6/1993 | Akiyama et al. | 400/61 |
| 5,291,227 | 3/1994 | Suzuki | 347/104 |
| 5,496,118 | 3/1996 | Ueno et al. | 400/61 |
| 5,536,092 | 7/1996 | Yamaguchi | 400/231 |
| 5,540,507 | 7/1996 | Niwa et al. | 400/83 |
| 5,587,214 | 12/1996 | Mitchell, Jr. | 428/40.1 |
| 5,838,354 | 11/1998 | Yamada et al. | 347/101 |
| 5,854,647 | 12/1998 | Ohtsuka | 347/101 |

FOREIGN PATENT DOCUMENTS

| | | | |
|---|---|---|---|
| 0 345 018 A1 | 12/1989 | European Pat. Off. | G03G 15/00 |
| 0 451 460 A2 | 10/1991 | European Pat. Off. | B41J 11/04 |
| 0 526 154 A2 | 2/1993 | European Pat. Off. | B41J 29/42 |
| 0 616 893 | 9/1994 | European Pat. Off. | B41J 2/17 |
| 0 616 893 A3 | 9/1994 | European Pat. Off. | B41J 2/17 |
| 3290260 | 12/1991 | Japan | B41J 2/165 |
| 4-286655 | 10/1992 | Japan | 347/22 |
| 6-166175 | 6/1994 | Japan | B41J 2/01 |
| 6166175 | 6/1994 | Japan | B41J 2/165 |

OTHER PUBLICATIONS

European Search Report for EP 95 11 6583 (from pending parent application Serial No. 08/545,943) May 1997.

English Language Abstract of Japanese Toku Kai Hei 2–192953 (Kawasaki) Jul. 1990.

English Language Abstract of Japanese Toku Kai Hei 4–364960 (Kitahara) Dec. 1992.

*Primary Examiner*—N. Le
*Assistant Examiner*—Shih-wen Hsieh
*Attorney, Agent, or Firm*—Loeb & Loeb, LLP

[57] ABSTRACT

A cartridge for an ink jet printer capable of directly or indirectly reducing the capacity of a wasted ink recovery unit without causing any restraint to a printing function, an ink jet printer adapted to accommodate this cartridge, and an ink jet printer capable of reducing a printing time without causing any restraint to the printing function are provided. In the cartridge for an ink jet printer, containing a printing article and removably mounted in an ink jet printer, a wasted ink recovery unit for storing wasted ink produced in the ink jet printer is provided in a cartridge case. This allows the capacity of the wasted ink recovery unit to be determined on the basis of a cartridge exchanging frequency. The ink jet printer adapted to accommodate this cartridge does not require a wasted ink recovery unit, so that its size can be reduced correspondingly.

40 Claims, 15 Drawing Sheets

CARTRIDGE FOR INK JET PRINTER AND INK JET PRINTER

TECHNICAL FIELD

The present invention relates to a cartridge for an ink jet printer which contains a printing article and is removably mounted in the ink jet printer, and an ink jet printer which is adapted to accommodate this cartridge.

BACKGROUND ART

In conventional ordinary ink jet printers, a printing head provided therein is moved in a lateral direction (main scanning direction) with respect to a printing article such as paper, while the printing article is fed in a longitudinal direction (sub-scanning direction), so that printing is performed. In this event, ink droplets are discharged toward the printing article from a plurality of ink nozzles of the printing head as required for the printing. On the other hand, when a printing operation is not performed, the printing head is positioned away from a printing operation range and faces a head cap since the ink nozzles are otherwise susceptible to clogging due to dried ink existing therein and to attachment of dust.

The head cap serves to seal the leading end of the printing head and suck ink droplets from the ink nozzles (i.e., clean the printing head). In addition, the head cap forces all of the ink nozzles of the printing head to discharge ink droplets prior to the start of a printing operation. Further, when printing is stopped for a few seconds during a printing operation, the printing head is also faced with the head cap such that all of the ink nozzles of the printing head are forced to discharge ink droplets (flushing) in order to prevent the ink nozzles from clogging due to dried ink.

Wasted ink thus sucked or discharged from the printing head is introduced from the head cap into a wasted ink tank (wasted ink recovery unit) by a wasted ink pump and stored therein. While the wasted ink tank is removably mounted in an ink jet printer such that wasted ink is removed therefrom when the wasted ink tank is filled with wasted ink, the capacity of an ordinary wasted ink tank is not designed on the assumption that the stored ink is removed, but on the basis of years of endurance of the ink jet printer (approximately 300 cc–500 cc).

A printer including an ink cartridge having a wasted ink tank integrated therewith is also known (for example, Japanese Laid-open Patent Applications Nos. 2-192953 and 4-364960). The disclosed printer has a wasted ink tank (having a capacity of several tens of cubic centimeters) defined in a portion of an ink cartridge (directly coupled to a printing head) for supplying the printing head with ink, so that wasted ink can be removed together with the ink cartridge when it is exchanged with new one.

In the conventional ink jet printer as mentioned above, the space for the wasted ink recovery unit (wasted ink tank) causes a large obstacle to a reduction in size of the ink jet printer. Specifically, since a wasted ink tank designed on the basis of years of endurance stores an amount of wasted ink in accordance with the years of endurance, a relatively large space is required therefor in an ink jet printer. A wasted ink tank included in an ink cartridge also requires a large space therefor because of movements of the wasted ink tank together with the ink cartridge, even if the capacity of the wasted ink cartridge itself is small.

Furthermore, since a conventional flushing operation requires a printing head to be moved to the position of a head cap during a printing operation, this causes a large loss of time, thus preventing a reduction in printing time.

It is therefore an object of the present invention to provide a cartridge for an ink jet printer which is capable of directly or indirectly reducing the capacity of a wasted ink recovery unit without any restraint to a printing function, an ink jet printer which is adapted to accommodate this cartridge, and an ink jet printer which is capable of reducing a printing time.

DISCLOSURE OF THE INVENTION

An invention of a cartridge set forth in claim 1 is a cartridge for an ink jet printer, containing a printing article and removably mounted in the ink jet printer, which is characterized by comprising a wasted ink recovery unit for storing wasted ink produced in the ink jet printer within a cartridge case. According to this configuration, the wasted ink recovery unit is not required in the ink jet printer, and wasted ink in the cartridge can be disposed each time the cartridge is exchanged. For this reason, the size of the wasted ink recovery unit in the cartridge can be determined on the basis of a cartridge exchange frequency, and an extremely small one may be employed.

Preferably, the wasted ink recovery unit comprises a plurality of separate recovery units separately defined in the cartridge case. According to this configuration, the wasted ink recovery unit can be divided into a plurality of units such that they are separately disposed in a cartridge case. Thus, the wasted ink recovery unit can be provided in free spaces in the cartridge case. This reduces the necessity of providing a larger cartridge for the wasted ink recovery unit.

Preferably, the ink jet printer is adapted to perform over-printing, wherein a print available region by the printing head can be set to a wider region than a printing article, and wasted ink produced in the ink jet printer includes wasted ink discharged outside the printing article in the over-printing, wasted ink caused by cleaning of the printing head, and wasted ink caused by flushing of the printing head. The wasted ink recovery unit comprises two separate recovery units including a first separate recovery unit for storing wasted ink due to cleaning and wasted ink due to flushing and a second separate recovery unit for storing wasted ink due to over-printing. According to this configuration, wasted ink due to cleaning and wasted ink due to flushing may be collectively sent to the first separate recovery unit on the printer side, while wasted ink due to over-printing may be directly received by the second separate recovery unit.

Preferably, the ink jet printer is adapted to perform over-printing, wherein a print available region by the printing head can be set to a wider region than a printing article, and wasted ink produced in the ink jet printer includes wasted ink discharged outside the printing article in the over-printing, wasted ink caused by cleaning of the printing head, and wasted ink caused by flushing of the printing head, and the wasted ink recovery unit comprises two separate recovery units including a first separate recovery unit for storing wasted ink due to cleaning and a second separate recovery unit for storing wasted ink due to flushing and wasted ink due to over-printing. According to this configuration, wasted ink due to cleaning may be sent from the printer to the first separate recovery unit, while wasted ink due to flushing and wasted ink due to over-printing may be directly received by the second separate recovery unit. It is also possible to balance the amounts of wasted ink stored in the first separate recovery unit and in the second separate recovery unit. Specifically, since the amount of wasted ink due to flushing is extremely smaller than the amount of wasted ink due to cleaning, the wasted ink due to flushing is added to wasted ink due to over-printing to balance the amount of wasted ink between the cleaning ink recovery unit and the flushing ink recovery unit.

Preferably, the cartridge case is formed with a wasted ink recovery window at a position corresponding to a moving path of the printing head in a state where the cartridge case is mounted in the ink jet printer, and the second separate recovery unit faces the wasted ink recovery window. According to this configuration, wasted ink discharged from the printing head, i.e., wasted ink involved in flushing and over-printing can be directly recovered in the second separate recovery unit.

Preferably, a printing article, when mounted in the ink jet printer, is fed out from the cartridge case and subsequently delivered ahead across the moving path of the printing head, and the cartridge case is provided with a guide for guiding the running of the printing article from the feed-out to the delivery. According to this configuration, it is not necessary to provide the ink jet printer with guiding means for guiding the printing article, after fed out from the cartridge case, to transverse the moving path of the printing head and go ahead. If the ink jet printer were provided with the guiding means, the printing article must be engaged with and disengaged from the guiding means in association with the mounting and removal of a cartridge, thus resulting in a complicated structure. In addition, when the guide is provided in the case cartridge, the guide is easy to manufacture and assemble.

Preferably, the guide is formed of a double-wall constituting a case outer wall of the cartridge case for guiding the printing article to pass between a gap formed between the double wall. According to this configuration, the guide can be integrally and readily formed in the cartridge case by constructing the case outer wall in a double-wall structure.

Preferably, the cartridge case is provided with a movable roller for sandwiching the printing article, mounted in the ink jet printer, with a fixed roller of the ink jet printer, and feeding out and delivering the printing article ahead in corporation with the fixed roller, and the movable roller is arranged for movements in directions in which the movable roller is brought into contact with and separated from the fixed roller, and the movable roller is urged in the contacting direction by an urging member disposed in the cartridge case. According to this configuration, with the printing article drawn to the position of the movable roller in the cartridge, only if the cartridge is mounted in the ink jet printer, the printing article is sandwiched between the movable roller and the fixed roller, whereby the cartridge is ready for feeding out the printing article. Stated another way, when the cartridge is mounted in the ink jet printer, the printing can be immediately started.

Preferably, the cartridge case is provided with a restriction abutting to the peripheral surface of the movable roller, with the printing article sandwiched therebetween, for restricting a moving end position of the movable roller by the urging member. According to this configuration, when the cartridge is removed from the ink jet printer, the movable roller abuts to the restriction with the printing article sandwiched therebetween. Thus, the leading end of the printing article is held at the position of the movable roller without being drawn back into the cartridge case. Therefore, when the cartridge is again used, no inconvenience will arise to the preparation for feeding the printing article.

Preferably, the movable roller has at least one smaller diameter portion in the axial direction, and the cartridge case has a feeding direction guiding member located at a position extending from the movable roller in its feeding direction for guiding a curved surface of the printing article, and the leading end of the feeding direction guiding member proximal to the movable roller is extended to face the smaller diameter portion. According to this configuration, the leading end of the printing article, after fed out, is transported without being obstructed on a path from the movable roller to the feeding direction guiding member. Thus, the position of the movable roller can be defined as a home position for (the leading end of) the printing article, so that the printing article can be printed from the leading end thereof. When the printing article is a tape-like article, the printing article can be prevented from being consumed for nothing.

Preferably, the printing article is a rolled tape-like article. According to this configuration, the wasted ink recovery unit is more easily to be arranged in a corner portion of the cartridge case, so that a larger cartridge case is not required for the wasted ink recovery unit.

An invention of an ink jet printer set forth in claim 24 is characterized in that a cartridge for an ink jet printer according to any of claims 1–23 is mounted therein. According to this configuration, since the wasted ink recovery unit can be provided in the cartridge, the ink jet printer can be correspondingly reduced in size. In addition, the wasted ink recovery unit itself may be a compact one.

An invention of an ink jet printer set forth in claim 25 is characterized in that an ink jet printer, having a cartridge for an ink jet printer according to claim 1 mounted therein, comprises wasted ink delivering means for delivering the wasted ink to the wasted ink recovery unit. According to this configuration, wasted ink produced in the ink jet printer need not be stored therein, so that the ink jet printer itself can be correspondingly reduced in size, and wasted ink produced in the ink jet printer can be appropriately delivered to the wasted ink recovery unit.

Preferably, the wasted ink delivering means comprises a wasted ink tube having an upstream end connected to a head cap and a downstream end connected to the wasted ink recovery unit, a wasted ink pump for delivering wasted ink in the head cap to the wasted ink recovery unit through the wasted ink tube, and a tube connecting mechanism for connecting and disconnecting the downstream end of the wasted ink tube to and from the wasted ink recovery unit of the cartridge mounted in the ink jet printer. According to this configuration, wasted ink from the head cap can be reliably delivered to the wasted ink recovery unit in the cartridge irrespective of the position at which the head cap is disposed. Also, controls for stopping the delivery of wasted ink, and so on can be readily performed when no cartridge is mounted. Furthermore, the wasted ink delivering means will not obstruct when a cartridge is mounted or removed.

Preferably, the tube connecting mechanism has an associative mechanism for holding the downstream end of the wasted ink tube, connecting the downstream end to the wasted ink recovery unit in association with an operation for mounting the cartridge, and disconnecting the downstream end from the wasted ink recovery unit in association with an operation for removing the cartridge. According to this configuration, since the downstream end of the wasted ink tube can be connected to and disconnected from the wasted ink recovery unit in association with operations for mounting and removing the cartridge in and from the ink jet printer, an operation for connecting and disconnecting the wasted ink tube is not necessary, so that complicated handling is eliminated. In addition, if the associative mechanism is formed of a link mechanism or the like, manual operations required for mounting and removing the cartridge may be utilized to connect and disconnect the wasted ink tube.

An invention of an ink jet printer set forth in claim 28 is characterized in that an ink jet printer, having the cartridge for in ink jet printer according to claim 1 mounted therein, is provided with full-charge detecting means for detecting that the wasted ink recovery unit is filled with wasted ink. According to this configuration, when the amount of wasted ink is more than a supposed amount, wasted ink can be prevented from overflowing from the wasted ink recovery unit. This prevents the inside of the cartridge, a printing article within the cartridge, and the inside of the ink jet printer from being stained by overflowing wasted ink.

Preferably, the cartridge has a throughhole formed through the cartridge case in communication with an upper end portion of the wasted ink recovery unit, and the full-charge detecting means has a sensor facing an upper end portion of the wasted ink recovery unit by way of the throughhole of the cartridge mounted in the ink jet printer, a wasted ink detecting circuit connected to the sensor, and a sensor inserting and removing mechanism for inserting and removing the sensor into and from the throughhole. According to this configuration, a fully charged state of wasted ink can be reliably detected, and the full-charge detecting means will not obstacle when the cartridge is mounted or removed.

Preferably, the ink jet printer is further provided with a lid for opening and closing a cartridge mounting bay for mounting a cartridge thereon, wherein the sensor inserting and removing mechanism has an associative mechanism for holding the sensor, inserting the sensor into the throughhole in association with a closing operation of the lid, and removing the sensor from the throughhole in association with an opening operation of the lid. According to this configuration, since the sensor can be inserted into and removed from the throughhole in association with the opening and closing operations of the lid, operations for inserting and removing the sensor are not required, thus eliminating complicated handling. Also, if the associative mechanism is formed of a link mechanism or the like, the structure can be simplified.

An invention of an ink jet printer set forth in claim 31 is an ink jet printer having a function of flushing a printing head and capable of setting a print available region to a wider region than a printing article which is characterized by comprising an overflow ink recovery unit for receiving wasted ink discharged from the printing head to an area outside the printing article, and a flushing ink recovery unit located adjacent to the overflow ink recovery unit for receiving wasted ink involved in flushing. According to this configuration, the flushing ink recovery unit is located adjacent to the overflow ink recovery unit, so that a moving distance of the printing head for flushing can be reduced to the utmost. Thus, a moving time required for flushing is reduced, and an entire printing time is also reduced. In addition, if a print available region is set to a region wider than a printing article, a background of an image (including patterns) can be printed.

Preferably, a pair of the flushing ink recovery units are disposed on both sides of a moving path of the printing head, sandwiching the printing article therebetween. According to this configuration, the printing head moving above the printing article may be moved to a nearer one of the pair of flushing ink recovery units when flushing is performed, so that a moving distance, i.e., a moving time of the printing head can be minimally reduced when flushing is performed.

Preferably, the overflow ink recovery unit and the flushing ink recovery unit are integrally formed. According to this configuration, the number of parts can be reduced, and the structure can be simplified.

Preferably, the ink jet printer is further provided with a cartridge containing the printing article and removably mounted in a printer body, wherein the overflow ink recovery unit and the flushing ink recovery unit are disposed in the cartridge. According to this configuration, wasted ink in the overflow ink recovery unit and the flushing ink recovery unit can be disposed together with exchange (abolition) of a cartridge. Stated another way, wasted ink produced in the ink jet printer can be directly thrown into the cartridge. In addition, the printer body can be correspondingly reduced in size.

Preferably, the printing article is a rolled tape-like article. According to this configuration, even if several kinds of printing articles having different widths are to be used, the overflow ink recovery unit and the flushing ink recovery unit can be made relatively compact.

BEST MODE FOR IMPLEMENTING THE INVENTION

An ink jet printer according to one embodiment of the present invention will hereinafter be described with reference to the accompanying drawings.

This ink jet printer prints, in color, desired characters or the like inputted thereto through a key operation on a tape-like printing article in an ink jet form. A printed portion is cut from the tape for creating a label. The tape is composed of a base tape having a front surface on which printing is performed and a back surface having an adhesive layer coated thereon, and a strippable paper covering the adhesive layer of the base tape. When a printed portion is cut from the tape, the strippable paper is stripped off the base tape so that the base tape may be adhered on a document file or the like as a label.

Figure 1:
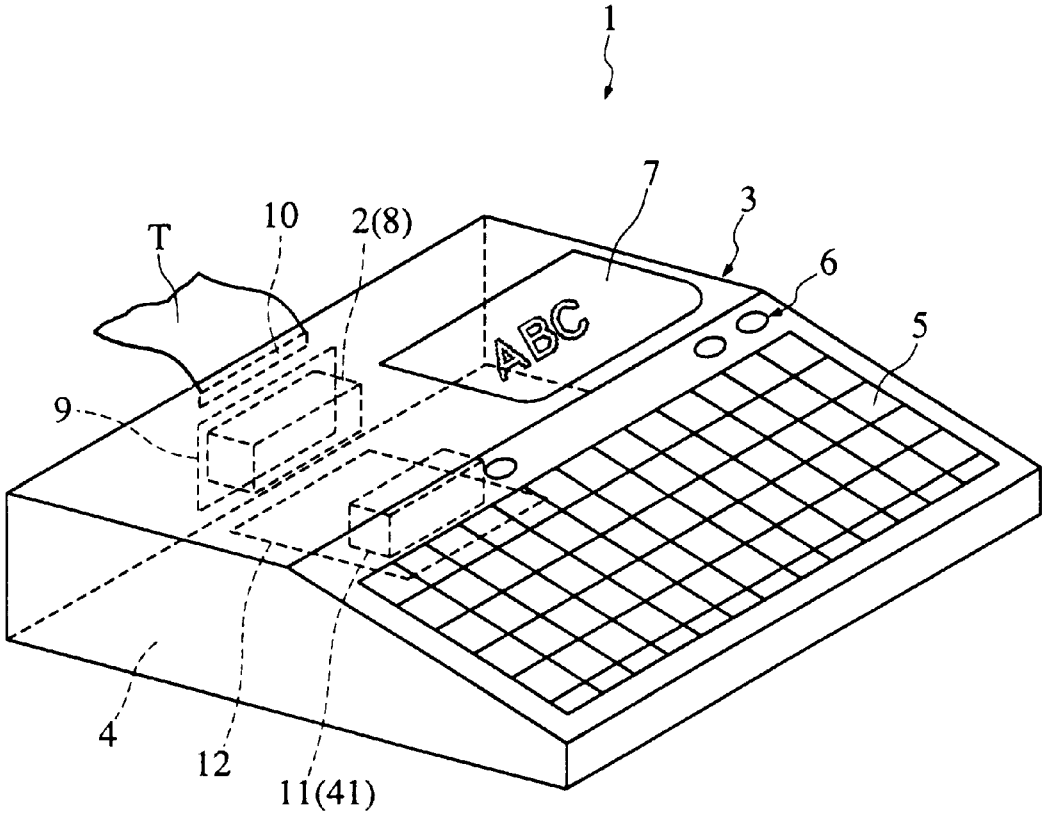
FIG. 1 is a perspective view illustrating an outer appearance of an ink jet printer according to a first embodiment of the present invention.

As illustrated in a perspective view of FIG. 1 depicting an outer appearance of the ink jet printer, the ink jet printer 1 comprises a tape cartridge 2 containing a tape T and a printer body 3 in which the tape cartridge 2 is removably mounted. The printer body 3, which has its outer shell defined by a body case 4, is provided with a key board 5 and a group of buttons 6 including a power button, a printing button, and so on a front portion and with a liquid crystal display 7 on a left rear portion.

An opening is formed through a rear wall of the body case 4 opposing a tape cartridge mounting bay 8 in which the tape cartridge 2 is mounted. The opening is provided with a first lid 9. A slit-like tape discharge port 10 is formed through the rear wall of the body case 4, positioned above the first lid 9, for discharging a printed tape T to the outside. In addition, an opening is formed through the bottom of the body case 4 opposing a cartridge holder 11 on which an ink cartridge 41, later described, is fixedly mounted. This opening is provided with a second lid 12.

Figure 2:
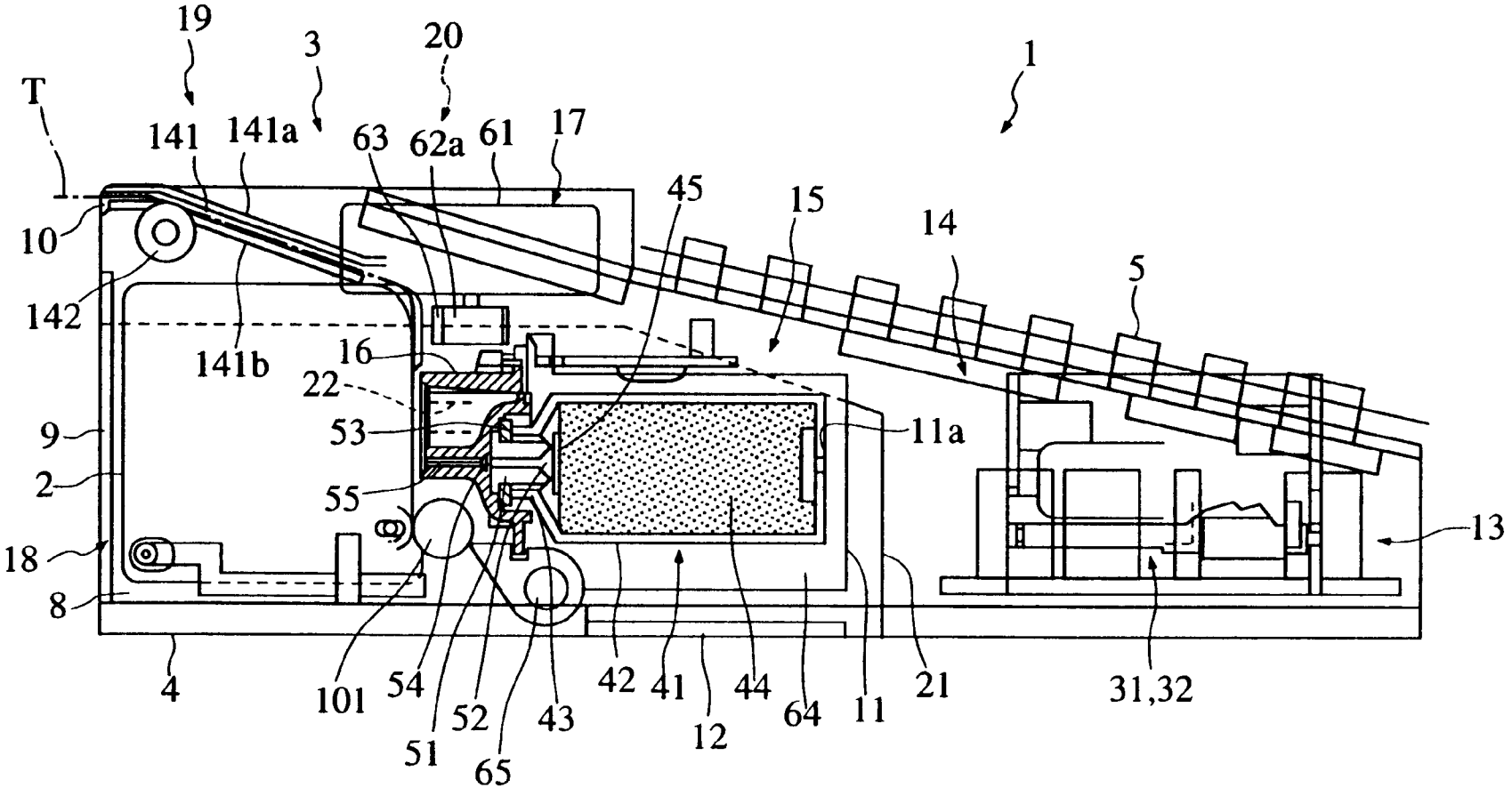
FIG. 2 is a cross-sectional view of the ink jet printer according to the first embodiment.

As illustrated in FIG. 2, arranged within the printer body 3 are a power supply section 13 and an information processing section 14 in a front portion; an ink supply section 15 including the ink cartridge 41, a printing head 16 communicating with the ink supply section 15, and a head driving section 17 for moving the printing head 16 together with the ink supply section 15 in an intermediate portion; and a tape supply section 18 including a tape cartridge 2, a tape discharge section 19 for delivering a printed tape T to the outside, and a wasted ink processing section 20 for discharging wasted ink in a rear portion, respectively. The ink supply section 15, the printing head 16, the head driving section 17, the tape supply section 18, the tape discharge section 19, and the wasted ink processing section 20 are supported by a base frame 21 and incorporated in the printer body 2 in an integrated form.

The power supply section 13, which comprises a battery 31 such as a nickel-cadmium battery or the like and a power supply unit 32, supplies electric power to respective internal devices including the information processing section 14, the head driving section 17, and so on. The information processing section 14, which comprises a control circuit for processing inputs from the keyboard 5, the button group 6, and so on, controls respective internal devices including the head driving section 17, the liquid crystal display 7, and so on.

The tape T, rolled off in the forward direction from the tape cartridge 2 of the tape supply section 18, turns upwardly to pass through a printing position of the printing head 16, and then turns backwardly to go out from the tape discharge section 19. The printing head 16 is driven by the head driving section 17 to repeat reciprocal movements in the lateral direction, associated with the running of the tape T, while it is supplied with ink from the ink supply section 15, and appropriately discharges ink droplets to perform printing on the tape T. In other words, the tape T is printed with the moving direction of the printing head 16 being the main scanning direction and the feeding direction of the tape T being the sub-scanning direction. In a state in which a printing operation is stopped or paused for a moment, the wasted ink processing section 20 cleans the printing head 16 in an inoperative state and flushes the printing head in a paused state (a few seconds or more), since ink droplets are likely to dry and coagulate on the leading end (ink nozzles) of the printing head 16. For this reason, the head driving section 17 drives the printing head 16 to move to the position opposing the wasted ink processing section 20 when the printing operation is stopped or paused.

Figure 3:
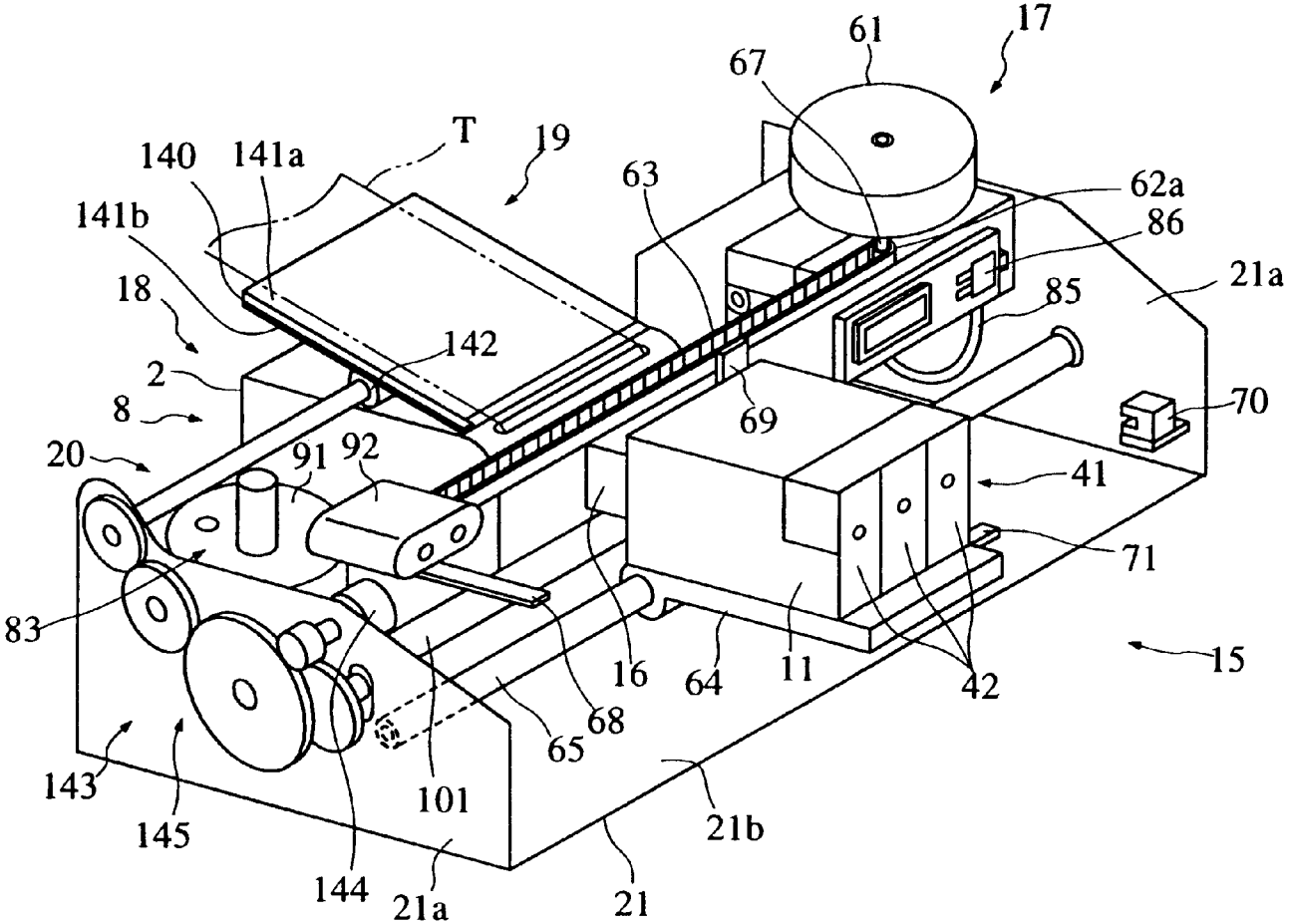
FIG. 3 is a perspective view illustrating internal mechanisms in the ink jet printer according to the first embodiment.

As illustrated in FIGS. 2 and 3, the ink supply section 15 is composed of the cartridge holder 11 carried on a carriage 64 of the head driving section 17 for holding the printing head 16 on one end thereof; and the ink cartridge 41 carried on the cartridge holder 11. The ink cartridge 41 has three ink tanks 42 integrated with each other. The three tank store ink of three colors including cyan, magenta and yellow, respectively. The cartridge holder 11 holds the ink cartridge 41 mounted thereon with its back plate 11*a* such that ink supply ports 43 are urged toward the printing head 16.

Each of the ink tanks 42 is filled with an ink absorbing material 44, and ink is stored as impregnated in the ink absorbing material 44. Each of the ink tanks 42 also contains a tank side filter 45 in contact with the ink absorbing material 44 adjacent to the ink supply port 43. The printing head 16, in turn, is provided with receiving members 51 formed with ink introducing ports 52 which are mated with the respective ink supply ports 43, and a sealing member 53 is arranged around each of the receiving members 51. The ink cartridge 41 is urged toward the printing head 16 with the ink supply ports 43 inserted into the receiving members 51, and is liquid-tight mounted on the printing head 16 such that the leading ends of the ink supply ports 43 crush the sealing members 53. The ink introducing port 52 communicates with an ink passage 55 in the printing head 16 through the head side filter 54, so that ink in each ink tank 42 is supplied to the ink passage 55 in the printing head 16 through the ink supply port 43 and the ink introducing port 52.

The head driving section 17 comprises a carriage motor 61; a pair of pulleys 62*a*, 62*b*; an endless timing belt 63 tensioned between the pair of pulleys 62*a*, 62*b*; a carriage 64 for supporting the cartridge holder 11; and a carriage guiding shaft 65 for guiding movements of the carriage 64. The carriage guiding shaft 65 is supported at both ends by both side plates 21*a*, 21*a* of the base frame 21, and the carriage 64 has its front portion slidably mounted on the carriage guiding shaft 65 and its rear portion slidably carried on a bottom plate 21*b* of the base frame 21 by means of a sliding protrusion, not shown, protruding from the bottom surface.

The carriage motor 61 is secured on a motor mounting plate 66 extending horizontally from a side plate 21*a* of the base frame 21 (see FIG. 4), and a driving pulley 62*a* is mounted on an output shaft 67 protruding downwardly from the motor mounting plate 66. A driven pulley 62*b* is positioned at a distance from the driving pulley 62*a* in the width direction of the base frame 21, and rotatably mounted on the leading end of a tension lever 68 supported by the base frame 21 (see FIG. 4). The timing belt 63 tensioned between the pulleys 62*a*, 62*b* is coupled to a fixture 69 extending from the printing head 16, such that the printing head 16 and the cartridge holder 11 are moved in association with the running of the timing belt 63. Stated another way, the timing belt 63 runs in the forward or backward direction in accordance with forward or backward rotation of the carriage motor 61, and the printing head 16 and the cartridge holder 11 carried on the carriage 64 are reciprocally moved in the lateral direction guided by the carriage guiding shaft 65 and the bottom plate 21*b* of the base frame 21.

Figure 4:
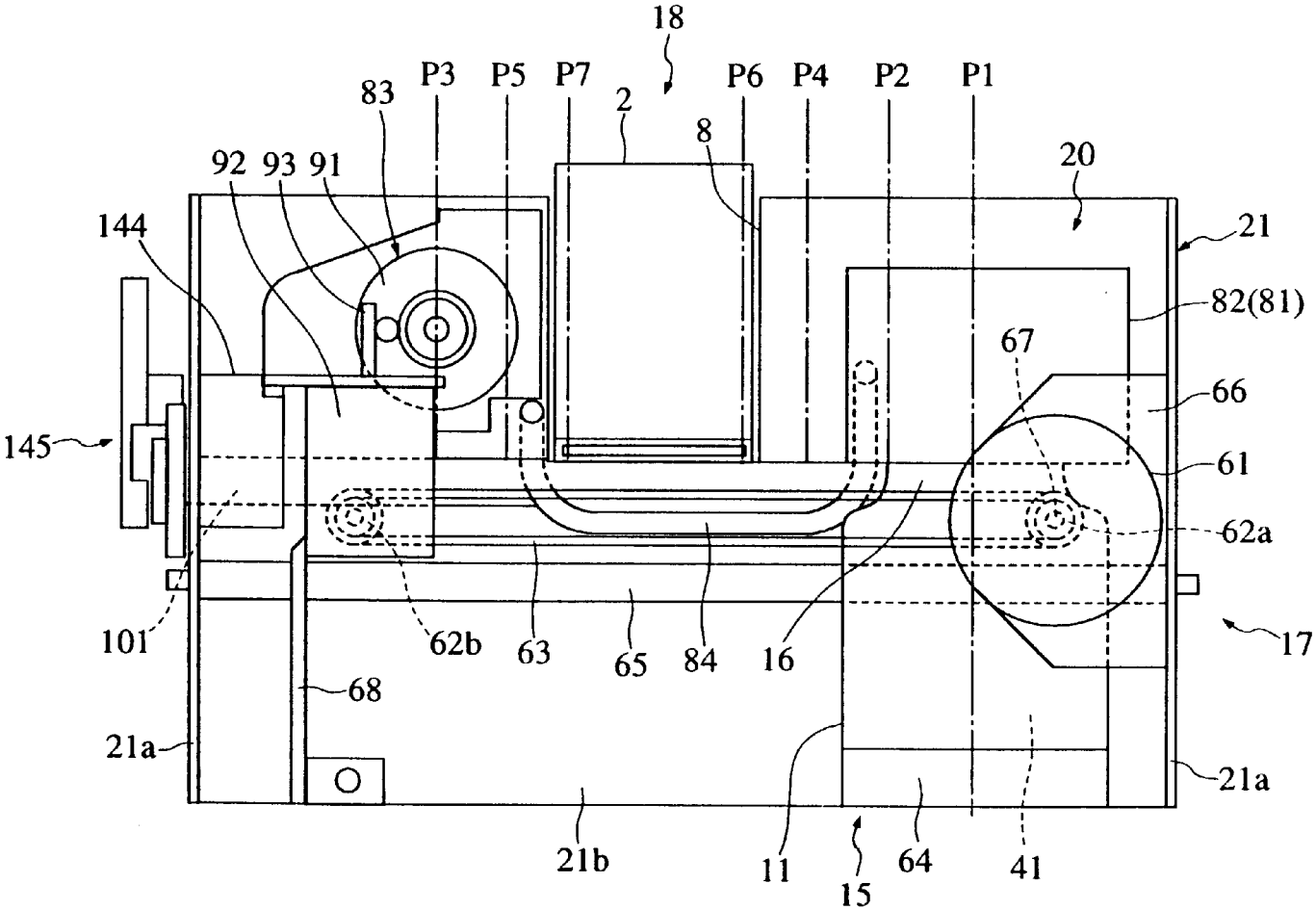
FIG. 4 is a top plan view of the internal mechanisms in the ink jet printer according to the first embodiment.

FIG. 4 shows a range of reciprocal movements of the printing head 16. The reciprocal movement range of the printing head, when performing a printing operation, is defined between a going movement start position P2 and a returning movement start position (turnup position) P3, where the tape cartridge 2 faces an intermediate position of the reciprocal movement range, and a home position P1 is set outside the going movement start position P2. Also, accelerating and decelerating regions are defined between the going movement start position P2 and a going movement fixed speed position P4 and between the returning movement start position P3 and a returning movement fixed speed position P5, both regions being located between the going movement start position P2 and the returning movement start position P3. Further, a going print start position P6 and a returning print start position P7 are set between the going movement fixed speed position P4 and the returning movement fixed speed position P5, and a print available region is defined between the going print start position and the returning print start position P7. Then, a free running region, in which the printing head moves at a fixed speed, is defined between the going movement fixed speed position P4 and the going print start position P6 and between the returning movement fixed speed position P5 and the returning print start position P7.

The printing head 16 stands by at the home position P1, and becomes accelerating from the going movement start position P2 in response to a print instruction, reaches a predetermined moving speed at the going movement fixed speed position P4, and starts a printing operation in the going direction from the going print start position P6. Further, as the printing head 16 reaches the returning print start position P7, the printing head 16 terminates the printing operation in the going direction, and stops at the returning movement start position P3 after passing the returning movement fixed speed position P5. Immediately afterward, the printing head 16 starts a movement in the returning direction, performs a printing operation in the returning direction between the returning printing start position P7 and the going print start position P6, and then stops at the going movement start position P2. The printing on the tape T is advanced as the printing head 16 repeats the reciprocal movements as described above.

Incidentally, reference numeral 70 in FIG. 3 designates a position detecting sensor mounted on the side plate 21*a* of the base frame 21 and comprising a photo-interrupter. When a light shielding plate 71 projecting from the carriage 64 faces the position detecting sensor 70, the carriage motor 61 is stopped. More specifically, when the moving printing head 16 reaches the home position P1, the position detecting sensor 70 detects this and forces the printing head 16 to stop at the home position P1 through the carriage motor 61. The home position P1 serves not only as a stand-by position for the printing head 16 but also as a reference position for the respective positions P2–P7. Specifically, a zero point (home position P1) of the carriage motor 61 is always corrected by the position detecting sensor 70, so that the carriage motor 61 rotates a predetermined number of steps (from P2 to P7) from the zero point to accurately position the printing head 16 at each of the positions P2–P7.

The printing head 16 has three groups of ink nozzles arranged in the horizontal direction, corresponding to three colors of ink, i.e., cyan, magenta, and yellow, and each of the ink nozzle groups is formed of a plurality of equally spaced ink nozzles 22 (see FIG. 2). In this case, three colors of ink are discharged as required to the same point on the tape T to realize a dot in a desired color.

The printing head 16 thus constructed is withdrawn at the home position P1 opposing the wasted ink processing section 20 when the ink jet printer 1 is powered OFF. Also, even if the ink jet printer 1 is powered ON, the printing head 16 is moved to the home position P1 opposing the wasted ink processing section 20 when a printing operation is paused for a certain time. In the former state, the wasted ink processing section 20 performs cleaning for sucking ink from the ink nozzles 22 of the printing head 16. In the latter state, the wasted ink processing section 20 performs flushing for discharging ink from all the ink nozzles 22 of the printing head 16.

Figure 5:
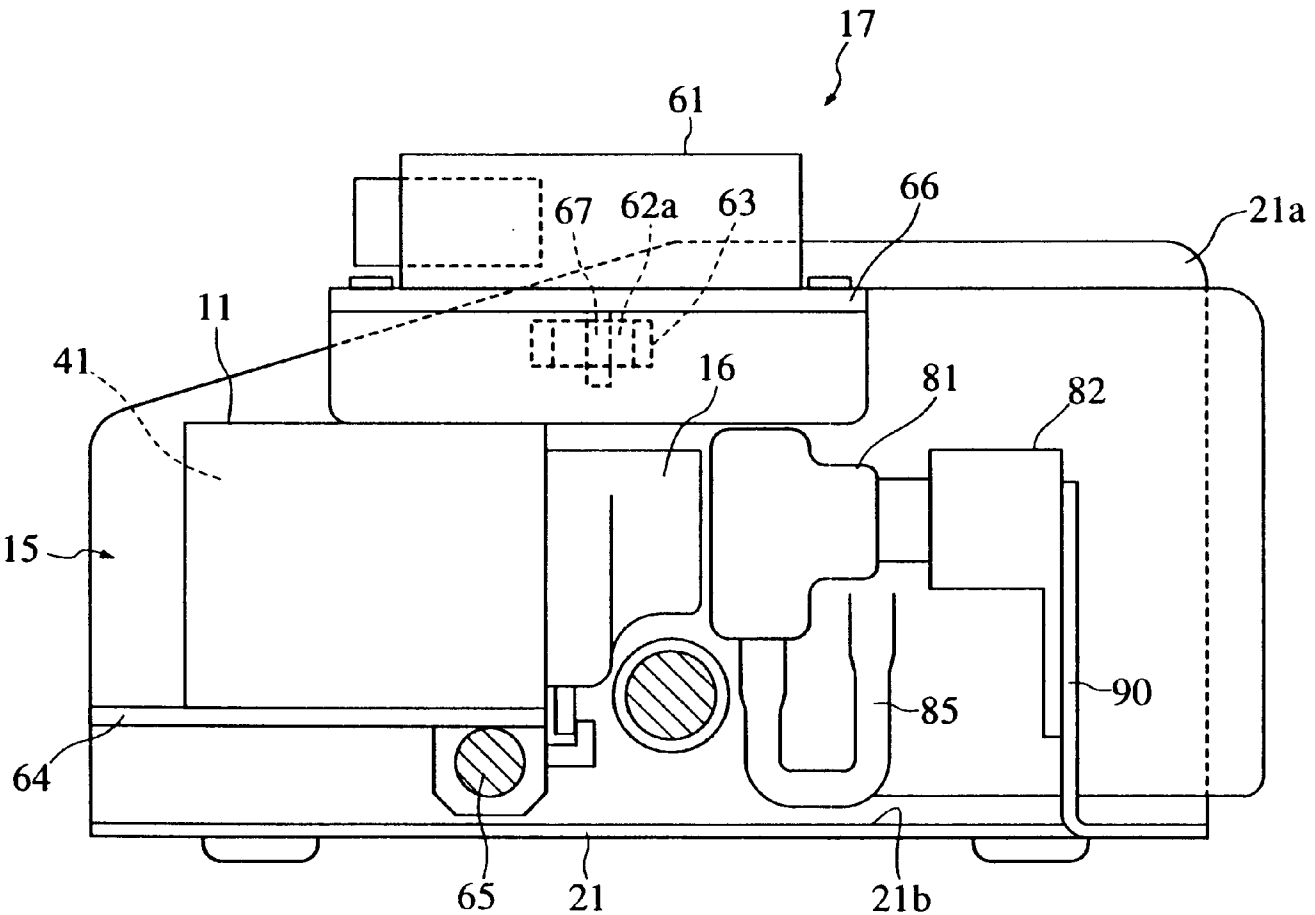
FIG. 5 is a cross-sectional view of a head cap and an associated structure in the ink jet printer according to the first embodiment.
Figure 6:
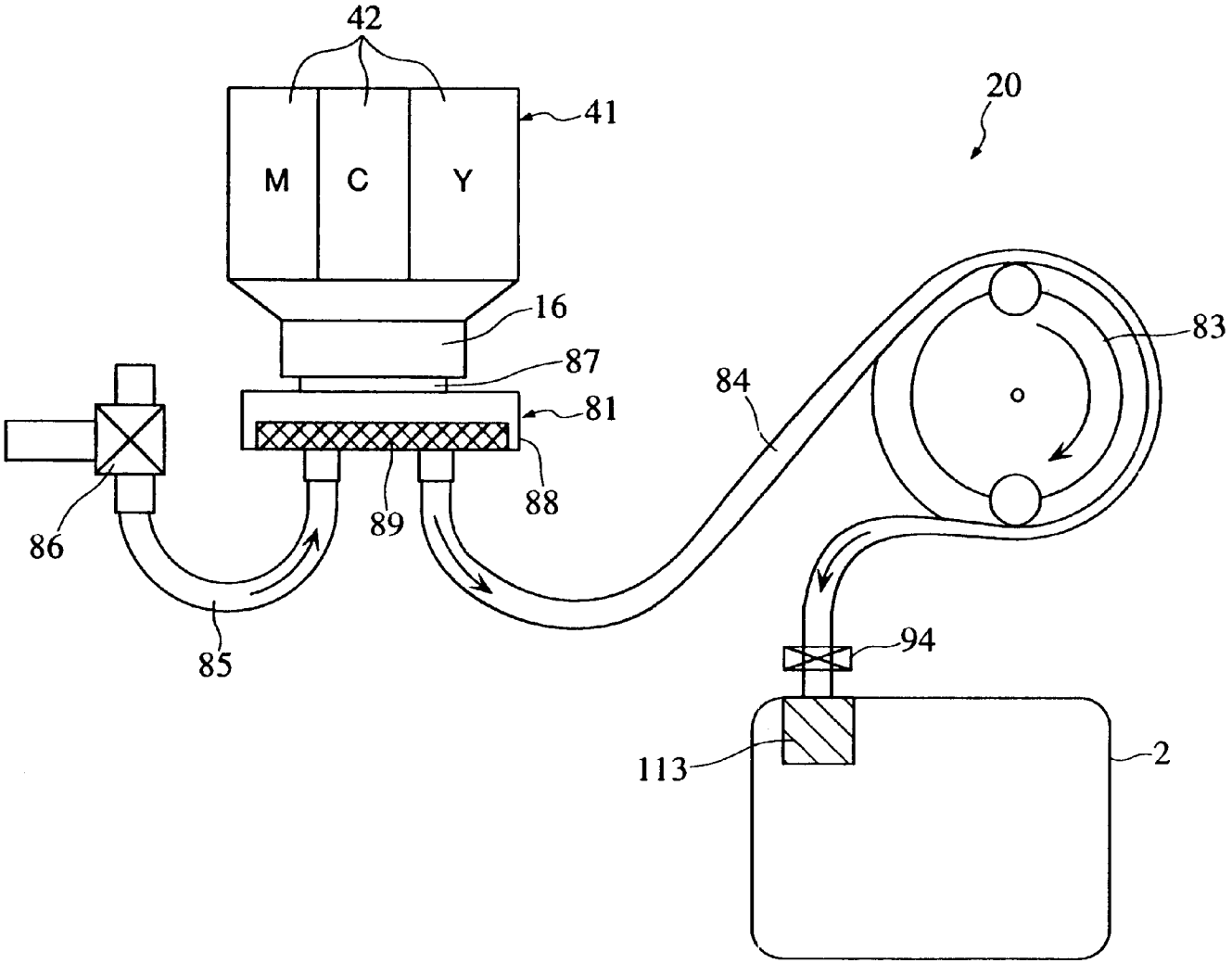
FIG. 6 is an explanatory diagram representing the structure of a wasted ink processing unit.

As illustrated in FIGS. 5 and 6, the wasted ink processing section 20 comprises a head cap 81 facing the printing head 16; a cap moving mechanism 82 for advancing and retracting the head cap 81; and a wasted ink pump 83 for delivering wasted ink in the head cap 81 to a wasted ink recovery unit 113, later described. The wasted ink recovery unit 113, details of which will be later described, is contained in the tape cartridge 2, and the wasted ink recovery unit 113 is connected to the head cap 81 through a ink delivering tube 84. The head cap 81 is also connected with a vent tube 85 having an end open to the atmosphere, with a valve unit 86 disposed in the middle of the vent tube 85.

During the cleaning, the cap moving mechanism 82 forces the head cap 81 to come into close contact with the printing head 16, and the wasted ink pump 83 is driven to such ink. After ink has been sucked, the closely contacted state between the head cap 81 and the printing head 16 is maintained to protect the ink nozzles 22 of the printing head 16 from suffering from coagulated (dried) ink and attachment of dust. During the flushing, in turn, ink is discharged from the printing head 16 toward the head cap 81 with the head cap 81 maintained spaced from the printing head 16.

The head cap 81 comprises a cap case 88 formed with an opening 87 facing the printing head 16, and an ink absorbing material 89 filling the cap case 88. The opening 87, protruding from the cap case 89, has an area covering all the ink nozzles 22. The edge of the opening 87 is pressed against the printing head 16 to seal a gap between the printing head 16 and the cap case 88. The cap moving mechanism 82 is mounted on a supporting plate 90 raised from the base frame 21, and advances the head cap 81 mounted at the leading end thereof to press the same against the printing head during the cleaning.

The wasted ink pump 83, positioned on the left of the tape cartridge mounting bay 8, is composed of a tube pump 91; a pump motor 92 for rotating the tube pump 91; and a pump gear train 93 for transmitting the power of the pump motor 92 to the tube pump 91 (see FIG. 4). The pump motor 92 rotates so as to wipe the ink delivering tube 84 wrapped therearound to suck wasted ink within the head cap 81. The form of suction is classified into a main suction for cleaning and an idle suction for simply sucking wasted ink staying in the head cap 81. Since the main suction sucks ink from the printing head 16, the valve unit 86 is actuated to close the vent tube 85. On the other hand, during the idle suction, the valve unit 86 is actuated to open the vent tube 85.

Figure 7:
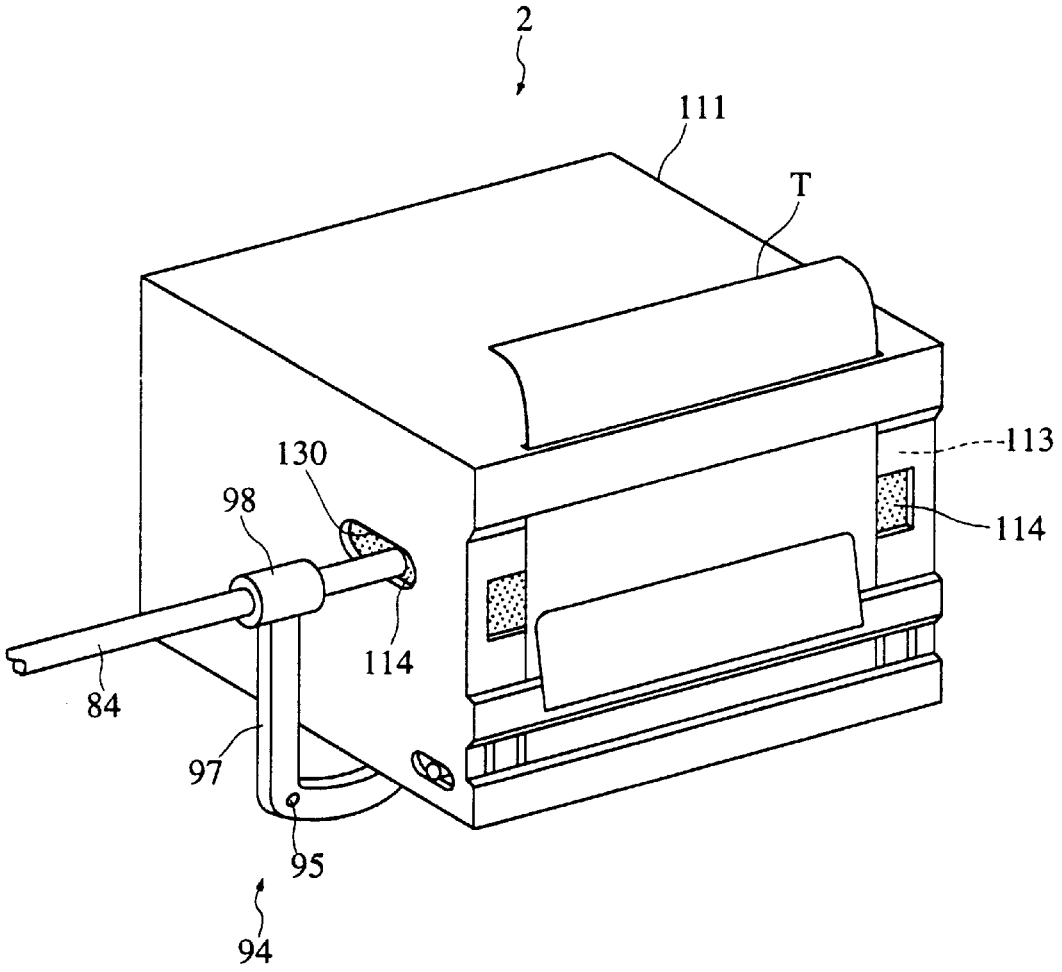
FIG. 7 is a perspective view illustrating a tube connecting mechanism and an associated structure.

The tape cartridge mounting bay 8 is also provided with a tube connecting mechanism 94 for connecting and disconnecting the lower end of the ink delivering tube 84 to and from the wasted ink recovery unit 113 of the tape cartridge 2. The tube connecting mechanisms 94 comprises an L-shaped rotary arm 97 rotatably mounted to the base frame 21 through a horizontal shaft 95 at an intermediate position, as illustrated in FIG. 7. The lower end of the ink delivering tube 84 is connected to a holder 98 disposed at one end of the rotary arm 97, such that the rotation of the rotary arm 97 about the horizontal shaft 95 causes the ink delivering tube 84 to be connected to and disconnected from the wasted ink recovery unit 113. The rotary arm 97 is formed, at the other end thereof, with a slope (not shown) along a direction in which the tape cartridge 2 is mounted or removed. Furthermore, although not shown, the rotary arm 97 is urged by a spring or the like to rotate in a connecting direction of the ink delivery tube 84.

When the tape cartridge 2 is mounted, the slope of the rotary arm 97 is engaged with the tape cartridge 2, and the rotary arm 97 rotates the ink delivering tube 84 in the connecting direction. Conversely, when the tape cartridge 2 is removed, the slope is disengaged from the tape cartridge 2, and the rotary arm 97 rotates the ink delivering tube 84 in the disconnecting direction. In this way, the ink delivering tube 84 is connected to the wasted ink recovery unit 113, in association with the mounting of the tape cartridge 2, to enable wasted ink to be delivered to the wasted ink recovery unit 113.

Next, the tape supply section 18 will be described with reference to FIGS. 2 and 8. The tape supply section 18 comprises the disposable tape cartridge 2 containing the tape T; a tape cartridge mounting bay 8 for mounting the tape cartridge 2 therein; and a driving roller (fixed roller) 101 for running the tape T. The tape cartridge mounting bay 8 is a container in the form of pocket formed in the printer body 3. When the tape cartridge 2 is mounted in the tape cartridge mounting bay 8 from behind and the first lid 9 is closed, the tape cartridge 2 is accommodated with its front, rear, left, and right positions aligned therein. The front surface of the aligned tape cartridge 2 faces the printing head 16, closely spaced therefrom, which reciprocally moves in the lateral direction.

The driving roller 101, disposed below the printing head 16, and is rotated by means of a power source served by a tape feed motor 144 of the tape discharge section 19, later described (see FIG. 3). The driving roller 101, which is in contact with a driven roller (later described) 115 of the tape cartridge 2 mounted in the tape cartridge mounting bay 8, draws out the tape T from the cartridge 2 to face the tape T with the printing head 16, and further delivers the tape T ahead, in corporation with the driven roller 115. Stated another way, the driving roller 101 and the driven roller 115 constitute a tape delivering roller 100 which delivers the tape T in a direction orthogonal to the moving (reciprocating) direction of the printing head 16, whereby the printing head 16 scans in the sub-scanning direction in a printing operation.

Figure 8B:
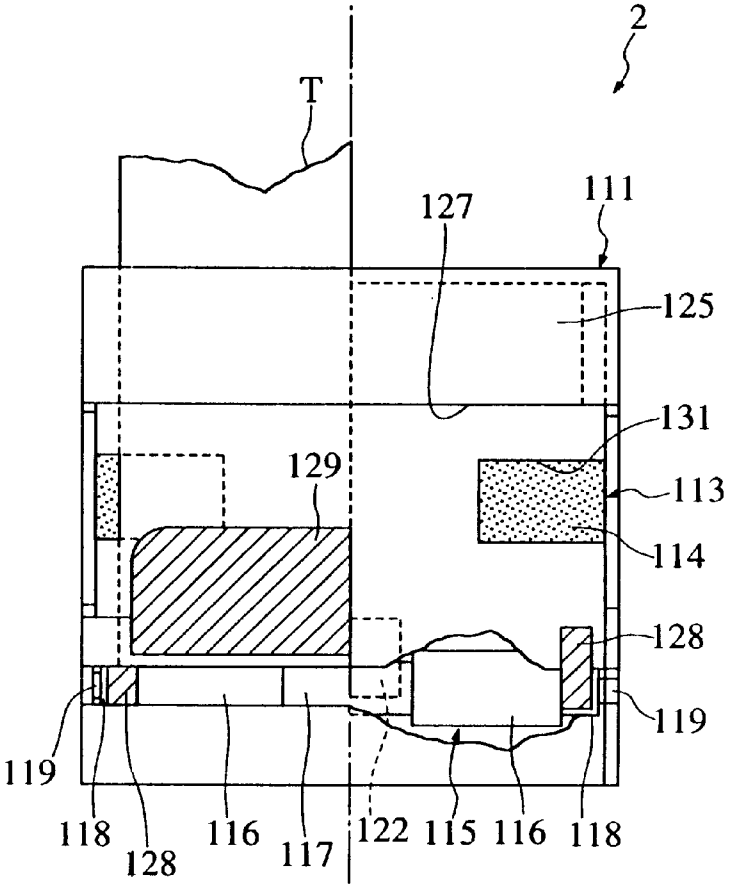
FIG. 8 illustrates the structure of a tape cartridge.
Figure 8A:
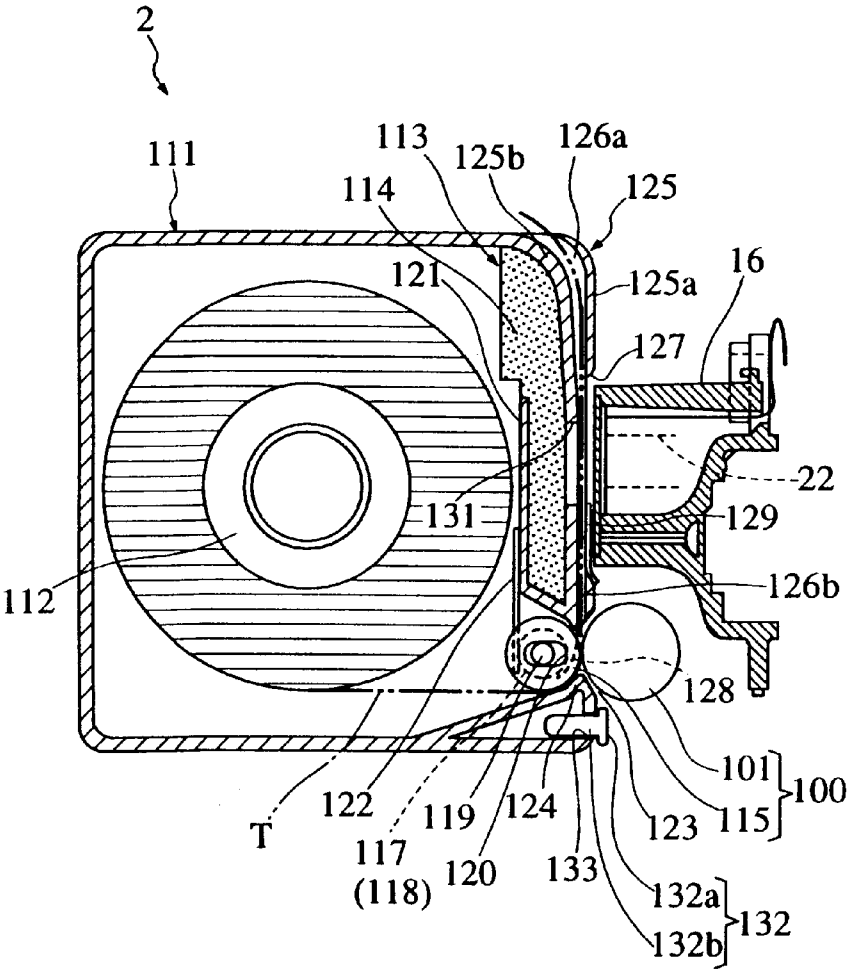

As illustrated in FIG. 8, the tape cartridge 2 has a rectangular solid cartridge case 111 in which the tape T rolled around a tape reel 112 is accommodated in an erected position. Also, the wasted ink recovery unit 113, filled with the ink absorbing material 114, is formed inside the cartridge case 111 in front of the wrapped tape T. Furthermore, the driven roller (movable roller) 115 is positioned below the wasted ink recovery unit 113. The tape reel 112 is rotatably supported by both side walls of the cartridge case 111, so that the tape T rolled therearound is drawn out from the lower side in a forward direction by the driven roller (and the driving roller 101) 115. Then, the tape T is guided in the upward direction along a front wall portion of the cartridge case 111, and then guided to the tape discharge unit 19 positioned diagonally to the rear of the cartridge case 111.

The driven roller 115 is integrally formed of a pair of roller bodies 116 having the largest diameter in the axial direction; an intermediate small diameter portion 117 positioned between the two roller bodies 116; a pair of outer small diameter portions positioned outside of the respective roller bodies 116; and a pair of shafts 119 having the smallest diameter and positioned further outside of the respective outer small diameter portions 118. The driven roller 115 is mounted such that the pair of shafts 119 are supported by shaft holes 120 formed in both side walls of the cartridge case 111. Each of the shaft hole 120 is an elongated hole extending in the lengthwise direction of the cartridge case 111. The driven roller 115 is supported by the shaft holes 120 for rotation and for movements in the lengthwise direction. A leaf spring (urging member) 122 having its base end fixed on a case inner wall 121 constituting the wasted ink recovery unit 113 abuts to the intermediate small diameter portion 117 of the driven roller 115, so that the driven roller 115 is urged thereby in the forward direction, i.e., toward the driving roller 101.

The cartridge case 111 is formed with a feed window 123 positioned in front of the driven roller 115 and extending horizontally over the entire width of the cartridge case 111. The driven roller 115 protrudes from this feed window 123 and is in contact with the driving roller 101 with the tape T sandwiched therebetween. Specifically, when the tape cartridge 2 is appropriately mounted in the tape cartridge mounting bay 8, the driven roller 115 abuts to the driving roller 101 with the tape T sandwiched therebetween, and the driven roller 115 is slightly urged back toward the cartridge case 111 against the leaf spring 122. When the tape cartridge 2 is drawn out from the tape cartridge mounting bay 8 in this state, the driven roller 115 is separated from the driving roller 101, and simultaneously pressed by the leaf spring 122 onto a lower window edge (restriction) 124 defining the feed window 123 with the tape T sandwiched between the driven roller 115 and the lower window edge 124.

In this case, the leading end of the tape T in a print waiting state, after being cut and withdrawn, is present at an intermediate position between the driven roller (tape feed roller 100) 115 and the printing head 16. Thus, by sandwiching the tape T between the driven roller 115 and the lower window edge 124, the tape T can be prevented from being withdrawn into the cartridge case 111, and moreover by mounting the tape cartridge 2, the tape T can be automatically placed in a print waiting state.

A front wall 125 of the cartridge case 111 has a double-wall structure, above the feed window 123, comprising a front outer wall **125*a* and a front inner wall 125*b* which constitute a guiding passage (guide) 126 for guiding the running of the tape. The front outer wall 125*a* has a cut-away portion facing the printing head 16, and is formed with a printing window 127 extending over the entire width of the cartridge case 111 in a manner similar to the feed window 123. Specifically, on both sides of the printing window 127, an upper guiding passage 126*a* is provided between the upper front outer wall 125*a* and the front inner wall 125*b*, while a lower guiding passage 126*b* is provided between the lower front outer wall 125*a* and the front inner wall 125*b*. The upper guiding passage 126*a* and the lower guiding passage 126*b* cause the tape T to run with a spaced distance with the printing head 16** (in the lengthwise direction) and the position in the width direction (in the lateral direction) being restricted thereby.

A pair of guiding plates (feed direction guiding members) 128 are mounted on the front inner wall **125*b* constituting the lower guiding passage 126***b* so as to extend the lower guiding passage 126*b* toward the driven roller 115. The leading ends of the respective guiding plates 128 face the respective outer small diameter portions 118 of the driven roller 115. Thus, even if the leading end of the tape T is located near the driven roller 115, the tape T is appropriately led along the lower guiding passage 126*b* through the guiding plates 118. It is therefore possible to prevent the leading end of the tape T unrolled from the tape reel 112 from being fed into the cartridge case 111 along the driven roller 115.

Further, a pressure guiding plate 129 is mounted on the front surface of the front outer wall 125*a* constituting the lower guiding passage 126*b* so as to extend the lower guiding passage 126*b* toward the printing head 16. The leading end of the pressure guiding plate 129 extends near the position of the ink nozzles 22 of the printing head 16. The pressure guiding plate 129, which has an elasticity, lightly presses the running tape T toward the front inner wall 125*b* with its elasticity in the printing window 124. In this way, a spaced distance between the ink nozzles 22 of the printing head 16 and the tape T facing the same is accurately maintained.

Inside the front wall 125 of the cartridge case 111, the wasted ink recovery unit 113 is positioned. The wasted ink recovery unit 113 is formed between both side walls of the cartridge case 111 in a portion defined by the front inner wall 125*b* and the case inner wall 121. Also, a side wall is formed with a connecting hole 130 faced with the leading end of the ink delivering tube 84 (see FIG. 7). When the ink delivering tube 84 is connected, the leading end thereof comes in contact with an upper portion of the ink absorbing material 114 filled in the wasted ink recovery unit 113 through the connecting hole 130. Furthermore, a pair of left and right wasted ink recovery windows 131 are formed through the front inner wall 125*b* at portions facing the ink nozzles 22 of the printing head 16.

Now, explanation will be given of why the pair of left and right wasted ink recovery windows 131 are provided. The ink jet printer 1 of this embodiment is capable of printing a background color (solid print) on the tape T, making good use of the nature of a color printer. In such a case, the aforementioned print available region (a region between P6 and P7) is set larger than the width of the tape in the ink jet printer 1 such that a background color can be reliably printed similarly on both outer end portions in the width direction of the tape T without leaving any unprinted area. Stated another way, the printing can be started from a position several dots outside of the outer edges in the width direction of the tape T (over-printing).

Specifically explaining, the pair of wasted ink recovery windows 131 serve as openings for directly introducing ink droplets discharged to the outside of the outer edges of the tape T due to the over-printing into the wasted ink recovery unit 113, so that the respective ink recovery windows 131 have their outer ends extending to the position of the side wall of the cartridge case 111 so as to reliably receive such ink droplets. In addition, the respective wasted ink recovery windows 131 preferably have a size which prevents a human's finger from entering.

In the tape cartridge 2 thus structured, ink droplets discharged from the ink nozzles 22 of the printing head 16 reach the tape T through the printing window 27, while ink droplets discharged to the outside of the tape T reach the surface of the ink absorbing material 114 through the printing window 127 and the wasted ink recovery window 131. Thus, the wasted ink recovery unit 113 for recovering "over-discharged" wasted ink is not required in the printer body 3, thereby making it possible to simplify the structure associated with the printing window 127.

When the tape cartridge 2 is mounted in the tape cartridge mounting bay 8, at least two positioning pins 132 are fitted into the tape cartridge 2 for positioning it at an appropriate position in the tape cartridge mounting bay 8. Corresponding to the positioning pins 132, the tape cartridge 2 is formed with at least two fitting holes 133 through the front wall thereof positioned in a lower end portion of the tape cartridge 2. Each of the positioning pins 132 is formed of a flange 132*a* opposing the printer body 3 and a pin body 132*b* protruding toward the tape cartridge mounting bay 8. The pin body 132*b* is fitted into the fitting hole 133 to position the tape cartridge 2 in the lateral direction, while a fitting hole edge defining the fitting hole 133 abuts to the flange 132*a* to position the tape cartridge 2 in the lengthwise direction.

Next, the tape discharge section 19 will be described with reference to FIGS. 2 and 3. The tape discharge section 19, serving to guide the tape T from the upper side of the tape cartridge 2 to the tape discharge port 10 diagonally to the rear of the tape cartridge 2, comprises upper and lower guiding plates 141*a*, 141*b* constituting a tape discharge passage 140; a discharge roller 142 facing the tape discharge passage 140 from an opening formed through the lower guiding plate 141*b*; and a driving mechanism 143 for rotating the discharge roller 142. In addition, a cutter, though not shown, is also provided between the tape cartridge 2 and the guiding plates 141*a*, 141*b* for cutting the tape T. In the alternative, the cutter may be positioned in an intermediate portion in the vertical direction of the upper guiding passage 126*a* of the tape cartridge 2.

The driving mechanism 143 has a tape feed motor 144 mounted inside the side plate 21*a* of the base frame 21; and a decelerating gear train 145 for transmitting the power of the tape feed motor 144 to the discharge roller 142, as illustrated in FIG. 3. The decelerating gear train 145 is positioned outside the side plate 21*a* of the base plate 21. As described above, the power from the decelerating gear train 145 is also transmitted to the driving roller 101 in parallel, so that the rotation of the tape feed motor 144 causes the discharge roller 142 and the driving roller (tape feed roller 100) 101 to simultaneously rotate to run the tape T.

When one complete process of printing operation is terminated, the tape T stops running and is cut by the cutter. Next, the tape T positioned downstream of the cut position is delivered by the discharge roller 142 from the tape discharge port 10 to the outside. The tape T positioned upstream of the cut position, on the other hand, is drawn back by the tape feed roller 100 until its leading end reaches near the position of the tape feed roller 100. Then, the print waiting state is entered.

As described above, in the ink jet printer 1 of this embodiment, the tape cartridge 2 contains the wasted ink recovery unit 113 such that wasted ink is recovered therein through the head cap 81, and wasted ink droplets are also recovered therein during over-printing. Therefore, a portion for storing recovered wasted ink need not be previously provided in the printer body 3. This is advantageous in realizing a smaller and more compact ink jet printer 1. The wasted ink recovery unit 113, formed in the tape cartridge 2, may be provided with a capacity in consideration of an exchange frequency of the tape cartridge 2 (a time period expected to use up the tape), and specifically may hold approximately 6 cc of wasted ink.

Next, another embodiment of the tape cartridge 2 will be described with reference to FIGS. 9 and 10. As described above, in this ink jet printer 1, wasted ink recovered in the wasted ink recovery unit 113 of the tape cartridge 2 is classified into wasted ink caused by cleaning and flushing and accumulated in the head cap 81 and wasted ink due to over-printing. Wasted ink in the head cap 81 is introduced into the wasted ink recovery unit 113 by the wasted ink pump 83, while wasted ink due to over-printing is introduced into the wasted ink recovery unit 113 directly from the printing head 16.

Figure 9:
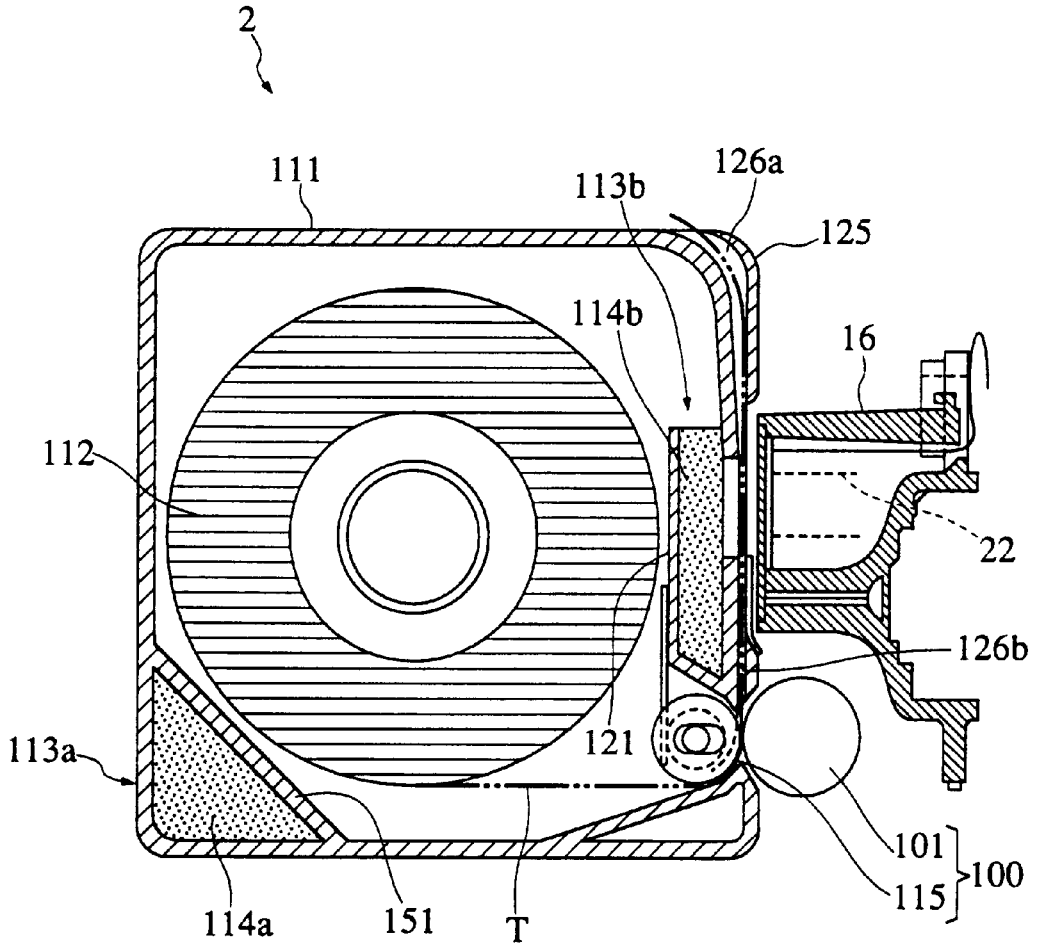
FIG. 9 is a cross-sectional view of a tape cartridge according to another embodiment.

Thus, in this embodiment, the tape cartridge 2 is provided with a wasted ink recovery unit 113 composed of a first wasted ink recovery unit (first separate recovery unit) 113*a* and a second wasted ink recovery unit (second separate recovery unit) 113*b*, such that the first wasted ink recovery unit 113*a* recovers wasted ink in the head cap 81, and the second wasted ink recovery unit 113*b* recovers wasted ink due to over-printing, as illustrated in FIG. 9. The second wasted ink recovery unit 113*b* is disposed at the same position as the wasted ink recovery unit 113 of the aforementioned embodiment and contains a less amount of ink absorbing material 114*b* compared with that of the aforementioned embodiment. The first ink recovery unit 113*a*, in turn, is formed by partitioning a corner portion on the lower rear side of the cartridge case 111 with a partition wall 151. The first ink recovery unit 113*a* is also filled with an ink absorbing material 114*a*.

Figure 10:
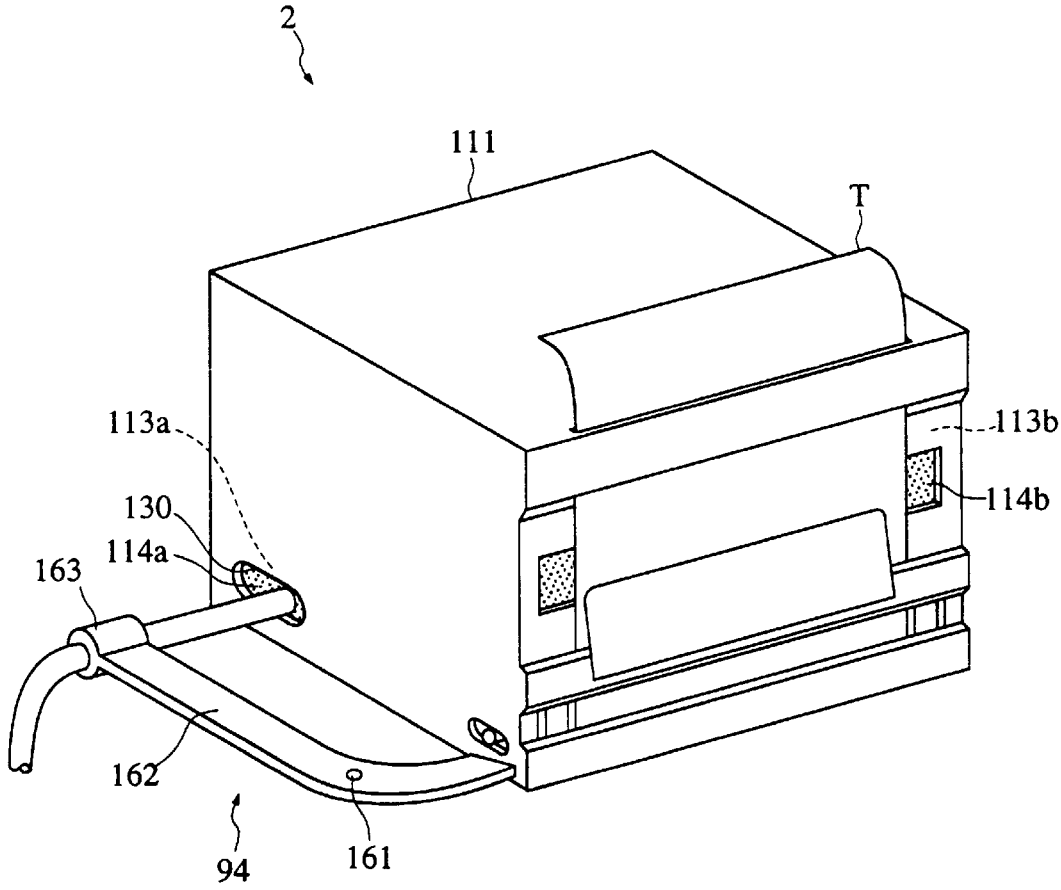
FIG. 10 is a perspective view illustrating a tube connecting mechanism and an associated structure corresponding to the other embodiment of the tape cartridge.

In the structure as described above, the cartridge case 111 is formed with a connection port 130 faced with the leading end of the ink delivering tube 84 at a position facing the first wasted ink recovery unit 113*a*, as illustrated in FIG. 10. Also, similarly to the aforementioned embodiment, a tube connecting mechanism 94 is provided for connecting and disconnecting the lower end of the ink delivering tube 84 to and from the first wasted ink recovery unit 113*a* of the tape cartridge 2. The tube connecting mechanism 94 comprises an L-shaped rotary arm 162 rotatably mounted to a base frame 21 through a vertical shaft 161 at an intermediate position. The lower end of the ink delivering tube 84 is connected to a holder 163 disposed at one end of the rotary arm 162, such that the rotation of the rotary arm 162 about the vertical shaft 161 causes the ink delivering tube 84 to be connected to and disconnected from the first wasted ink recovery unit 113*a*. Also in this case, the rotary arm 162 is formed, at the other end thereof, with a slope (not shown) along a direction in which the tape cartridge 2 is mounted or removed. Furthermore, though not shown, the rotary arm 162 is urged by a spring or the like to rotate in a connecting direction of the ink delivery tube 84.

The separation of the wasted ink recovery unit 113 into the first wasted ink recovery unit 113*a* and the second wasted ink recovery unit 113*b*, as described above, is advantageous when the layout of the respective units is restricted: for example, the connection with the ink suction tube 84 cannot be formed on the front wall side of the tape cartridge 2, and so on. Also, a free space within the cartridge case 111 can be effectively utilized.

It should be noted that since the first wasted ink recovery unit 113*a* recovers wasted ink involved in cleaning, the amount of recovered wasted ink is larger than that of the second wasted ink recovery unit 113*b*. Particularly, if a cleaning function is frequently performed by a manual operation, wasted ink may overflow the first wasted ink recovery unit 113*a*. To avoid this inconvenience, this embodiment provides a full-charge detecting means 171 for detecting a fully charged state of the first wasted ink recovery unit 113*a*.

Figure 11A:
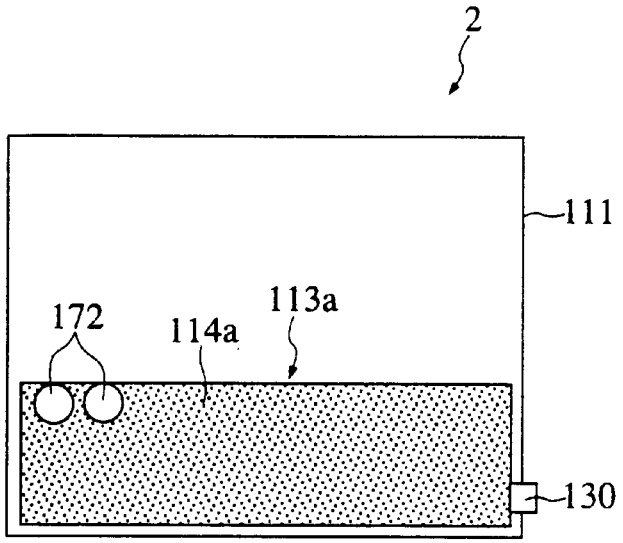
FIG. 11 is a schematic diagram generally illustrating the structure of a means for detecting a filled wasted ink recovery unit in the tape cartridge.
Figure 11B:
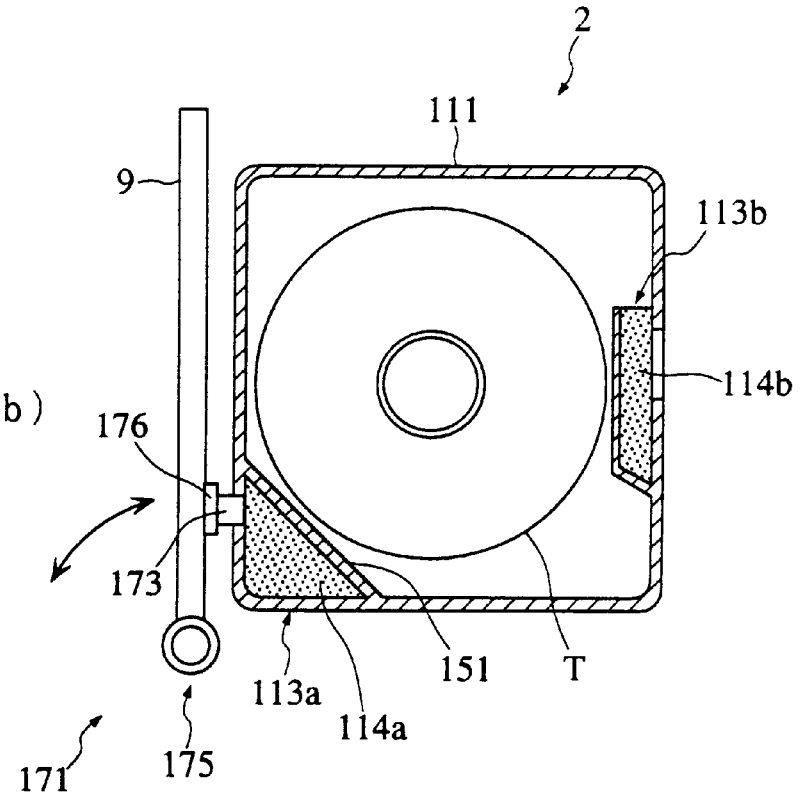
Figure 12:
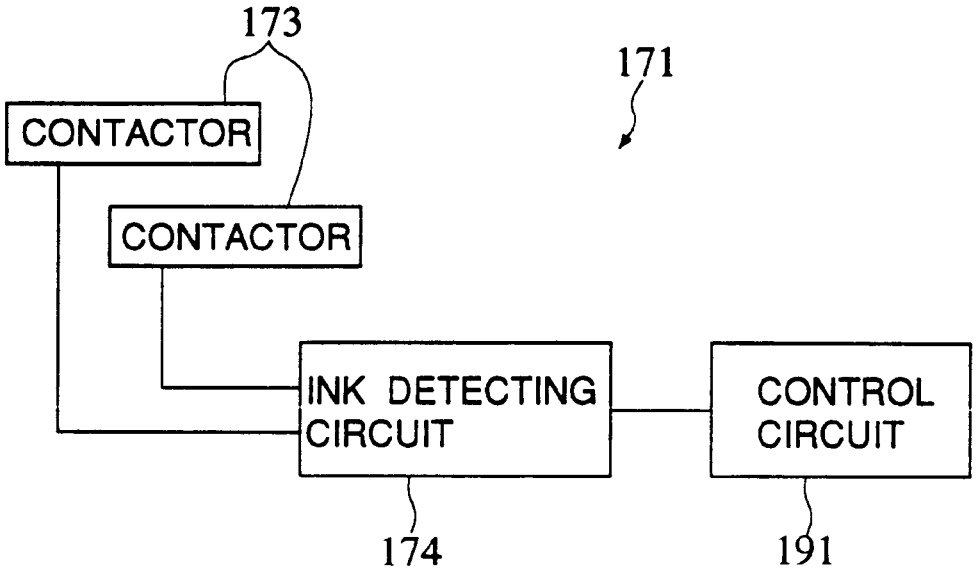
FIG. 12 is an explanatory diagram illustrating the configuration of the means for detecting a filled wasted ink recovery unit in a detector circuit.

As illustrated in FIGS. 11 and 12, the cartridge case 111 is formed with two detecting holes 172 through the rear wall thereof facing the first wasted ink recovery unit 113*a*. A pair of contactors 173, functioning as a sensor of the full-charge detecting means 171, are removably positioned opposite to the two detecting holes 172. The full-charge detecting means 171 is composed of the pair of contactors 173; an ink detecting circuit 174 connected to the pair of contactors 173; and a contactor mounting/removing mechanism 175 for mounting and removing the pair of contactors 173 with respect to the two detecting holes 172.

The contactor mounting/removing mechanism 175 is composed of the first lid 9 for opening and closing the tape cartridge mounting bay 8, and a contactor holder 176 disposed inside the first lid 9. The pair of contactors 173 are held in the contactor holder 176. When the first lid 9 is closed after mounting the tape cartridge 2 in the tape cartridge mounting bay 8, the pair of contactors 173 are inserted into the associated detecting holes 172 and come in contact with the ink absorbing material 114*a* in the first wasted ink recovery unit 113*a*. Conversely, when the first lid 9 is opened, the pair of contactors 173 are drawn out from the associated detecting holes 172.

The ink detecting circuit 174, in turn, detects the resistance value of the ink absorbing material 114*a* between the pair of contactors 173, and outputs a full-charge signal to a control circuit 191, later described, when the ink absorbent material 114*a* is fully impregnated with wasted ink to cause the resistance value of the ink absorbent material 114*a* to reach a predetermined value. In this way, a liquid crystal display 7, for example, displays that the first wasted ink recovery unit 113*a* is full, or a printing operation is stopped, through the control circuit 191. It should be noted that although the tape cartridge 2 is formed with the connecting port 130, the detecting holes 172, and so on, ink will never leak from these openings when the ink absorbing material 114 can absorb wasted ink.

Since a fully charged state of the first wasted ink recovery unit 113*a* can be detected in the manner mentioned above, wasted ink can be prevented from leaking from the first wasted ink recovery unit 113*a*, so that the tape cartridge 2 and the tape cartridge mounting bay 8 are free from inconveniences such as stains due to wasted ink.

Next, an ink jet printer 1 according to a second embodiment of the present invention will be described. This ink jet printer 1 directly performs flushing in connection with a wasted ink recovery unit 113 of a tape cartridge 2, whereas the ink jet printer 1 of the first embodiment performs flushing in connection with the head cap 81. In the following description on the second embodiment, portions different from the first embodiments will only be referred to.

Figure 13B:
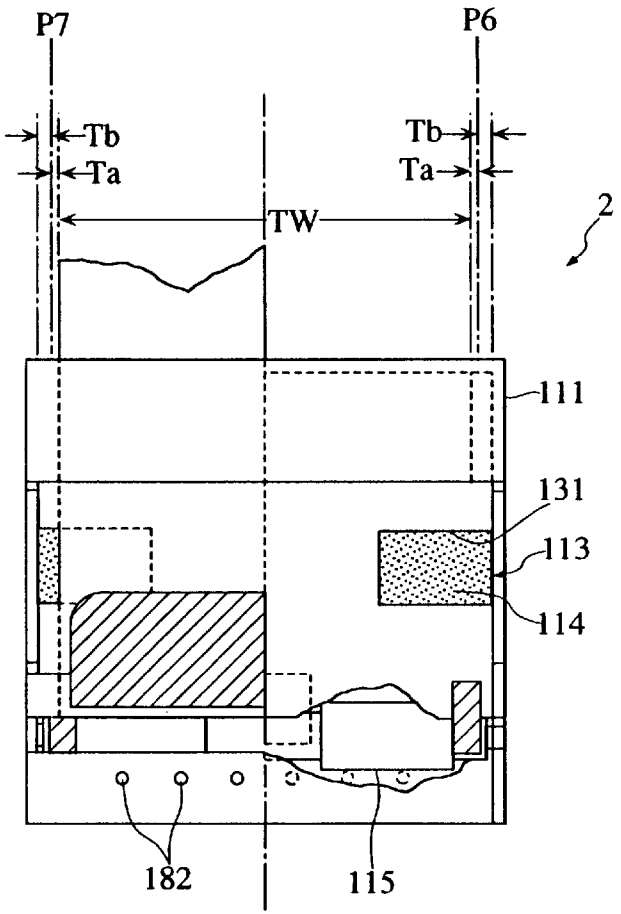
FIG. 13 is a diagram illustrating the structure of a tape cartridge for an ink jet printer according to a second embodiment of the present invention.
Figure 13A:
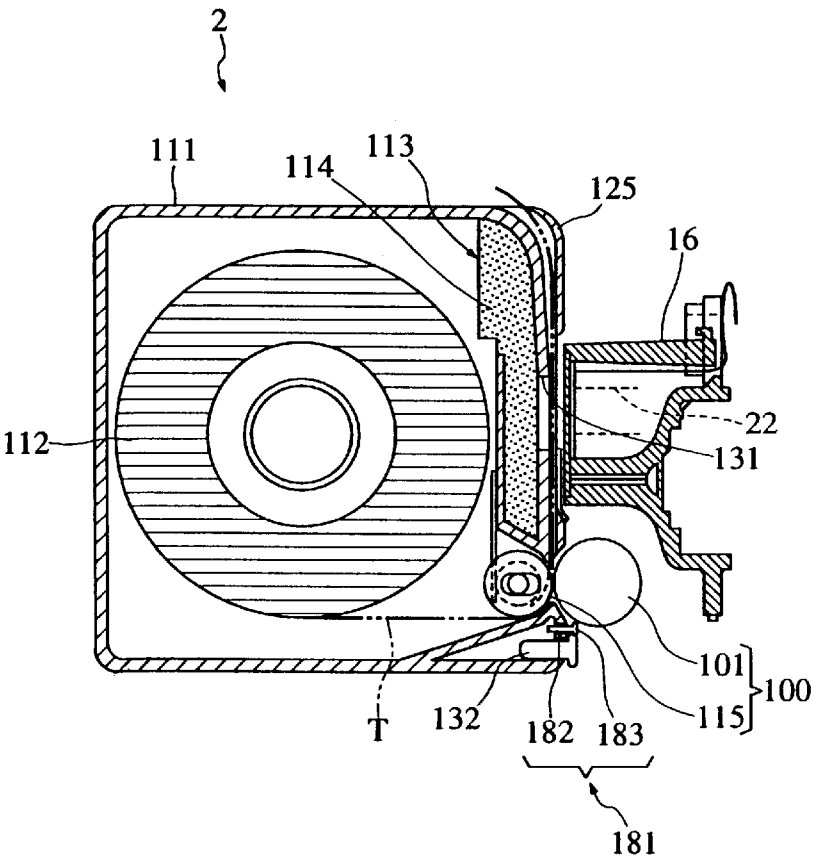

FIG. 13 corresponds to FIG. 8 of the fist embodiment, where the wasted ink recovery unit 113 of the ink cartridge 2 receives wasted ink from a printing head 16 due to over-printing and wasted ink involved in flushing directly discharged thereto through a wasted ink recovery window 131. As illustrated in FIG. 13(*b*), left and right overflow regions Ta, Ta are defined outside a tape width (including a tolerance of the tape width) Tw, and left and right flushing regions Tb, Tb are set further outside the respective overflow regions Ta. In this case, the area between both the overflow regions Ta, Ta defines the aforementioned print available region (form P6 to P7). and the flushing regions Tb are set outside thereof. The respective overflow regions Ta are, for example, approximately 0.5 mm (several dots) wide, while the respective flushing regions Tb are, for example, approximately 1.0 mm (several tens of dots) wide.

It should be noted that the over-printing may be performed not only in the width direction of the tape T but also in the lengthwise direction of the tape T. Specifically, the setting can be made so as to start printing from a position away from the leading end of the tape T. In such a case, the pair of left and right wasted ink recovery windows 113 are joined to define a strip-like recovery window. In addition, the strip-like recovery window is preferably provided with a bridge member for guiding the leading end of the tape T. Furthermore, the wasted ink recovery window 131 may be split into a first ink recovery window 131*a* and a second ink recovery window 131*b* as is the case of the first embodiment (the other embodiment of the tape cartridge).

There may be provided several kinds of tape cartridges 2 containing tapes T of different widths, which is also applied to the tape cartridge 2 in the first embodiment completely in the same manner. For such a case, it is necessary to automatically set a print available region and so on in accordance with the width of a used tape T. For this purpose, a cartridge discriminating means 181 is provided for discriminating the kind of a tape cartridge 2.

The cartridge discriminating means 181 has a plurality of small holes 182 formed through a front wall in a lower portion of a cartridge case 111, and a plurality of detecting protrusions 183 disposed on the printer body 3 for detecting the presence or absence of the small holes 182. The plurality of detecting protrusions 183, though depending on the number of kinds of the tape cartridges (tape widths) 2, may comprise, for example, six protrusions laterally arranged at uniform intervals. Though not shown, each of the detecting protrusions 183 is mounted on a switch terminal of a push switch, such that the push switch turns "OFF" when it is inserted into a corresponding small hole 182 and turns "ON" when no corresponding small hole 182 exists and the push switch is pushed by the cartridge case 111.

The plurality of small holes 182 of the cartridge case 111, on the other hand, are formed at positions corresponding to the six detecting protrusions 183, however, the number of the small holes 182 is six or less as required. Specifically, the kind of the cartridge case 111 can be represented by the number of the small holes 182 and the positions at which the small holes are formed. More specifically, when the tape cartridge 2 is mounted in the tape cartridge mounting bay 8, the kind of the tape cartridge 2 can be detected by ON-OFF states of the six switches. In addition, the cartridge discriminating means 181, when used, can discriminate the material of the tape T other than the width of the tape T.

Figure 14:
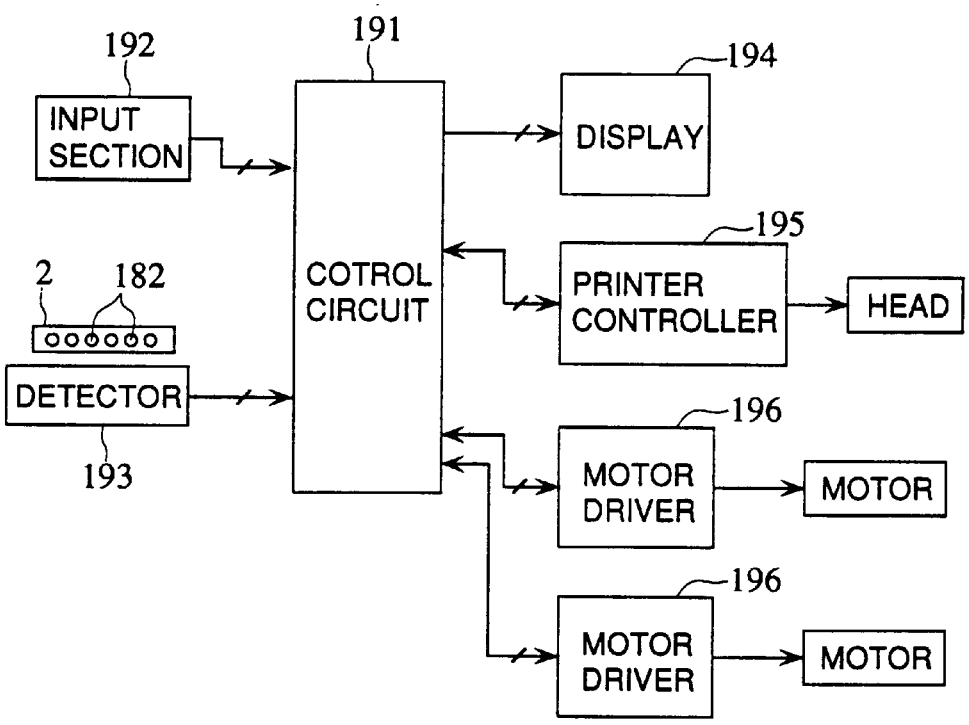
FIG. 14 is a block diagram illustrating a control system in the ink jet printer according to the second embodiment.

Now, a main control system of the ink jet printer 1 will be briefly described below. As illustrated in FIG. 14, reference numeral 191 designates a control circuit comprising a microcomputer which is connected, on the input side thereof, to an input section 192 of the ink jet printer 1 composed of the keyboard 5, the button group 6, and so on. The control circuit 191 is connected on the output side thereof to a display unit 194 such as the liquid crystal display 7 for a variety of displays; a printer controller 195 for controlling a printing operation performed by the printing head 16; and motor drivers 196, 197 for controlling and driving associated motors. Based on a control program previously stored in a ROM of the control circuit 191, a print range is set corresponding to the width of a tape contained in the mounted tape cartridge 2 under the control of the control circuit 191. Also, a print range wider than a tape width may be set to perform the aforementioned over-printing operation and flushing operation.

As described above, the ink jet printer 1 of this embodiment sets a print available range laterally wider than the width of a mounted tape to perform solid printing over the entire width of the tape as well as to recover ink droplets discharged outside the edges of the tape T in the solid printing by means of the wasted ink recovery unit 113. Further, ink droplets caused by flushing are also recovered by the wasted ink recovery unit 113.

Thus, according to the ink jet printer 1 of the second embodiment, it is not necessary to move the printing head 16 to the position of the head cap 81 (P1 in FIG. 4) for flushing, so that a time required to move the printing head 16 for flushing can be eliminated. It is therefore possible to reduce an overall printing time.

Also, since the wasted ink recovery unit 113 is disposed in the tape cartridge 2 in a manner similar to the first embodiment, a portion for storing recovered wasted ink need not be previously provided in the printer body 3. This is advantageous in realizing a smaller and more compact ink jet printer 1.

Alternatively, the wasted ink recovery unit 113 in the second embodiment may be disposed in a guiding member provided in the printer body 3 for defining a printing position on the tape T. In this case, the guiding member may be provided with an ink filter on a front surface for absorbing ink therethrough, and an ink absorbing material on a rear surface, such that ink can be absorbed and held through the ink filter.

Further alternatively, employed as the wasted ink recovery unit 113 may be a type which moves integrally with the printing head 16. For example, since a printer for printing over a wide printing article such as a poster or the like has a wide print range, it is necessary to dispose a wasted ink recovery unit covering the entire print range in order to perform over-printing at positions beyond a lateral or vertical edge of the print range. However, this would require a large space for installing the wasted ink recovery unit and would not be economical. To cope with such a situation, a wasted ink recovery unit movable together with a printing head may be employed, in which case a smaller wasted ink recovery unit may be used.

Figure 15:
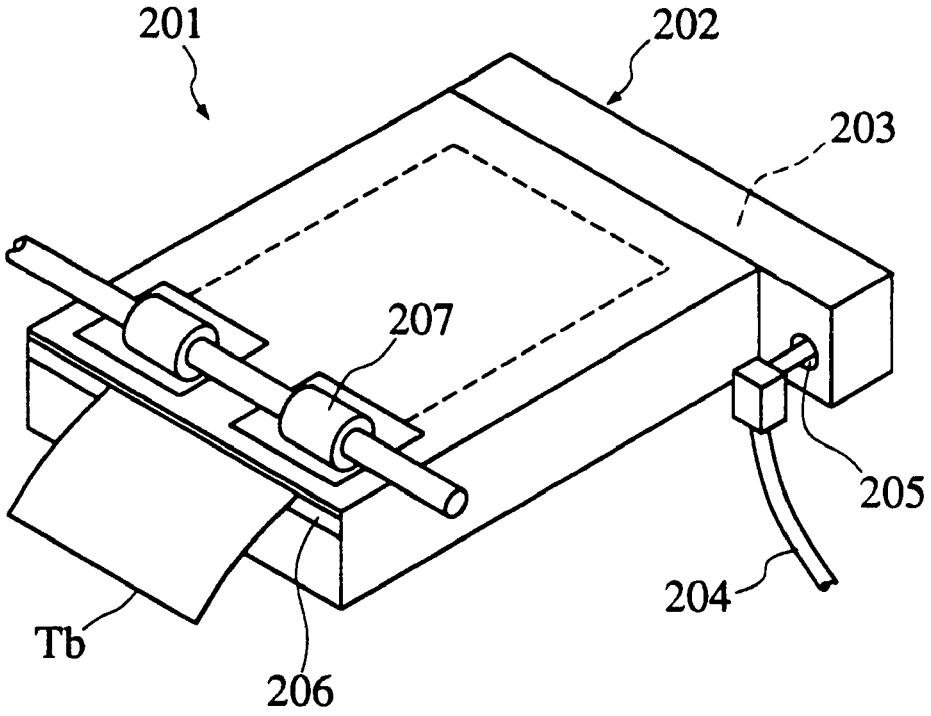
FIG. 15 is a perspective view illustrating a cut sheet cartridge and an associated structure for an ink jet printer according to a third embodiment of the present invention.

Next, an ink jet printer 1 according to a third embodiment of the present invention will be described with reference to FIG. 15. This ink jet printer 1 is adapted to print on a cut sheet Tb such as a post card. Although details of the configuration are omitted, a large number of cut sheets Tb are contained in a cut sheet cartridge 201 in a stacked manner.

In this case, a wasted ink absorbing unit 202 may be disposed in a rear end portion of the cut sheet cartridge 201 with an ink absorbing material 203 contained therein. In addition, one end of the wasted ink recovery unit 202 may be protruded in a lateral direction, and a connection port 205 for inserting the leading end of an ink delivering tube 204 thereinto may be formed in the protruded portion. In this case, sheet separating rollers 207 are provided near a feed-out port 206 of the cut sheet cartridge 201 for feeding the cut sheet Tb therethrough, such that the contained cut sheets Tb are fed out one by one from the top.

When the present invention is applied to the cut sheet cartridge 201 as described above, similar effects can also be produced as is the case of the aforementioned tape cartridge 2. With such cut sheets Tb, a significant amount of ink is consumed during years of endurance of the ink jet printer 1. Therefore, if a wasted ink recovery unit were provided within a printer body, the recovery unit would be required to have a capacity of recovering an extremely large amount of wasted ink, with the result that a large space would be necessary. In contrast, when the wasted ink recovery unit 202 is disposed in the cut sheet cartridge 201, as the present invention does, the printer body will require a less space because a less amount of wasted ink will be stored until cut sheets contained in the cut sheet cartridge 201 are used up.

The present invention can also be applied to those other than the type of printing in three colors: cyan, magenta, and yellow, as in the foregoing embodiments. For example, the present invention can be applied, for example, to an ink jet printer which uses only black ink, and to an ink jet printer having four or more colors.

Possibility of Industrial Utilization

As described above, the cartridge for an ink jet printer and the ink jet cartridge adapted to accommodate this cartridge are suitable for reducing the size of a printer since the wasted ink recovery unit is disposed in the cartridge. They are also suitable for reducing a printing time.

I claim:

1. A cartridge for an ink jet printer, said cartridge containing a printing article for recording of desired image data thereon by the ink jet printer and removably mounted in the ink jet printer, characterized by:

comprising a wasted ink recovery unit for storing wasted ink produced in said ink jet printer within a cartridge case.

2. A cartridge for an ink jet printer according to claim 1, characterized in that said wasted ink recovery unit comprises a plurality of separate recovery units separately defined in said cartridge case.

3. A cartridge for an ink jet printer according to claim 2, characterized in that:

said ink jet printer is adapted to perform over-printing, wherein a print available region by a printing head can be set to a wider region than a printing article, and wasted ink produced in said ink jet printer includes wasted ink discharged outside said printing article in the over-printing, wasted ink caused by cleaning of said printing head, and wasted ink caused by flushing of said printing head; and said wasted ink recovery unit comprises two separate recovery units including a first separate recovery unit for storing wasted ink due to cleaning and wasted ink due to flushing and a second separate recovery unit for storing wasted ink due to over-printing.

4. A cartridge for an ink jet printer according to claim 3, characterized in that:

said cartridge case is formed with a wasted ink recovery window at a position corresponding to a moving path of said printing head in a state where said cartridge case is mounted in said ink jet printer; and said second separate recovery unit faces said wasted ink recovery window.

5. A cartridge for an ink jet printer according to claim 4, characterized in that:

a printing article, when mounted in said ink jet printer, is fed out from said cartridge case and subsequently delivered ahead across the moving path of said printing head; and said cartridge case comprises a guide for guiding the running said printing article from said feed-out to said delivery.

6. A cartridge for an ink jet printer according to claim 5, characterized in that said guide is formed of a double-wall constituting a case outer wall of said cartridge case for guiding the printing article to pass between a gap formed between the double wall.

7. A cartridge for an ink jet printer according to claim 4, characterized in that:

said cartridge case comprises a movable roller for sandwiching the printing article, mounted in said ink jet printer, with a fixed roller of said ink jet printer, and feeding out and delivering said printing article ahead in corporation with said fixed roller; and said movable roller is arranged for movements in directions in which said movable roller is brought into contact with and separated from said fixed roller, and said movable roller is urged in the contacting direction by an urging member disposed in said cartridge case.

8. A cartridge for an ink jet printer according to claim 7, characterized in that said cartridge case comprises a restriction abutting to the peripheral surface of said movable roller with the printing article sandwiched therebetween, for restricting a moving end position of said movable roller by said urging member.

9. A cartridge for an ink jet printer according to claim 8, characterized in that:

said movable roller has at least one smaller diameter portion in the axial direction, and said cartridge case has a feeding direction guiding member located at a position extending from said movable roller in its feeding direction for guiding a curved surface of the printing article; and the leading end of said feeding direction guiding member proximal to said movable roller is extended to face said smaller diameter portion.

10. A cartridge for an ink jet printer according to claim 8, characterized in that said printing article is a rolled tape-like article.

11. A cartridge for an ink jet printer according to claim 7, characterized in that:

said movable roller has at least one smaller diameter portion in the axial direction, and said cartridge case has a feeding direction guiding member located at a position extending from said movable roller in its feeding direction for guiding a curved surface of the printing article; and the leading end of said feeding direction guiding member proximal to said movable roller is extended to face said smaller diameter portion.

12. A cartridge for an ink jet printer according to claim 11, characterized in that said printing article is a rolled tape-like article.

13. A cartridge for an ink jet printer according to claim 4, characterized in that said printing article is a rolled tape-like article.

14. A cartridge for an ink jet printer according to claim 2, characterized in that:

said ink jet printer is adapted to perform over-printing, wherein a print available region by said printing head can be set to a wider region than a printing article, and wasted ink produced in said ink jet printer includes wasted ink discharged outside said printing article in the over-printing, wasted ink caused by cleaning of said printing head, and wasted ink caused by flushing of said printing head; and said wasted ink recovery unit comprises two separate recovery units including a first separate recovery unit for storing wasted ink due to cleaning and a second separate recovery unit for storing wasted ink due to flushing and wasted ink due to over-printing.

15. A cartridge for an ink jet printer according to claim 2, characterized in that said wasted ink recovery unit comprises separate recovery units including a first separate recovery unit for storing wasted ink due to the flushing and a second separate recovery unit for storing wasted ink due to cleaning and wasted ink due to over-printing.

16. A cartridge for an ink jet printer according to claim 2, characterized in that at least one of the wasted ink due to over-printing, the wasted ink due to cleaning and the wasted ink due to flushing is recovered by the wasted ink recovery unit.

17. A cartridge for an ink jet printer according to claim 1, characterized in that:

a printing article, when mounted in said ink jet printer, is fed out from said cartridge case and subsequently delivered ahead across the moving path of said printing head; and said cartridge case comprises a guide for guiding the running said printing article from said feed-out to said delivery.

18. A cartridge for an ink jet printer according to claim 17, characterized in that said guide is formed of a double-wall constituting a case outer wall of said cartridge case for guiding the printing article to pass between a gap formed between the double wall.

19. A cartridge for an ink jet printer according to claim 17, characterized in that:

said cartridge case comprises a movable roller for sandwiching the printing article, mounted in said ink jet printer, with a fixed roller of said ink jet printer, and feeding out and delivering said printing article ahead in corporation with said fixed roller; and said movable roller is arranged for movements in directions in which said movable roller is brought into contact with and separated from said fixed roller, and said movable roller is urged in the contacting direction by an urging member disposed in said cartridge case.

20. A cartridge for an ink jet printer according to claim 17, characterized in that said printing article is a rolled tape-like article.

21. A cartridge for an ink jet printer according to claim 1, characterized in that:

said cartridge case comprises a movable roller for sandwiching the printing article, mounted in said ink jet printer, with a fixed roller of said ink jet printer, and feeding out and delivering said printing article ahead in corporation with said fixed roller; and said movable roller is arranged for movements in directions in which said movable roller is brought into contact with and separated from said fixed roller, and said movable roller is urged in the contacting direction by an urging member disposed in said cartridge case.

22. A cartridge for an ink jet printer according to claim 21, characterized in that said cartridge case comprises a restriction abutting to the peripheral surface of said movable roller with the printing article sandwiched therebetween, for restricting a moving end position of said movable roller by said urging member.

23. A cartridge for an ink jet printer according to claim 21, characterized in that:

said movable roller has at least one smaller diameter portion in the axial direction, and said cartridge case has a feeding direction guiding member located at a position extending from said movable roller in its feeding direction for guiding a curved surface of the printing article; and the leading end of said feeding direction guiding member proximal to said movable roller is extended to face said smaller diameter portion.

24. A cartridge for an ink jet printer according to claim 21, characterized in that said printing article is a rolled tape-like article.

25. A cartridge for an ink jet printer according to claim 1, characterized in that said printing article is a rolled tape-like article.

26. An ink jet printer having a cartridge for an ink jet printer mounted therein according to claim 1.

27. An ink jet printer having a cartridge for an ink jet printer according to claim 1 mounted therein, characterized by comprising:

wasted ink delivering means for delivering said wasted ink to said wasted ink recovery unit.

28. An ink jet printer according to claim 27, characterized in that:

said wasted ink delivering means comprises:

a wasted ink tube having an upstream end connected to a head cap and a downstream end connected to said wasted ink recovery unit;

a wasted ink pump for delivering wasted ink in said head cap to said wasted ink recovery unit through said wasted ink tube; and a tube connecting mechanism for connecting and disconnecting the downstream end of said wasted ink tube to and from said wasted ink recovery unit of said cartridge mounted in said ink jet printer.

29. An ink jet printer according to claim 28, characterized in that said tube connecting mechanism comprises an associative mechanism for holding the downstream end of said wasted ink tube, connecting said downstream end to said wasted ink recovery unit in association with an operation for mounting said cartridge, and disconnecting said downstream end from said wasted ink recovery unit in association with an operation for removing said cartridge.

30. An ink jet printer having the cartridge for in ink jet printer according to claim 1 mounted therein, characterized by comprising full-charge detecting means for detecting that said wasted ink recovery unit is filled with wasted ink.

31. An ink jet printer according to claim 30, characterized in that:

said cartridge comprises a throughhole formed through said cartridge case in communication with an upper end portion of said wasted ink recovery unit; and said full-charge detecting means comprises:

a sensor facing an upper end portion of said wasted ink recovery unit by way of said throughhole of said cartridge mounted in said ink jet printer;

a wasted ink detecting circuit connected to said sensor; and a sensor inserting and removing mechanism for inserting and removing said sensor into and from said throughhole.

32. An ink jet printer according to claim 31, characterized by further comprising a lid for opening and closing a cartridge mounting bay for mounting a cartridge thereon;

wherein said sensor inserting and removing mechanism comprises an associative mechanism for holding said sensor, inserting said sensor into said throughhole in association with a closing operation of said lid, and removing said sensor from said throughhole in association with an opening operation of said lid.

33. An ink jet printer having a function of flushing a printing head and capable of setting a print available region to a wider region than a printing article, characterized by comprising:

an overflow ink recovery unit for receiving wasted ink discharged from said printing head to an area outside the printing article the overflow ink recovery unit being disposed relative to the printing article so that there is no gap therebetween; and a flushing ink recovery unit located adjacent to said overflow ink recovery unit for receiving wasted ink involved in flushing.

34. An ink jet printer according to claim 33, characterized by further comprising a second flushing ink recovery unit, the second flushing ink recovery unit and the first mentioned flushing ink recovery unit being disposed on both sides of a moving path of said printing head, sandwiching the printing article therebetween.

35. An ink jet printer according to claim 33, characterized in that said overflow ink recovery unit and said flushing ink recovery unit are integrally formed.

36. An ink jet printer according to claim 35, wherein said printing article is a rolled tape-like article.

37. An ink jet printer according to claim 33, wherein said printing article is a rolled tape-like article.

38. An ink jet printer according to claim 33, wherein said printing article is a rolled tape-like article.

39. An ink jet printer having a function of flushing a printing head and capable of setting a print available region to a wider region than a printing article characterized by comprising:

an overflow ink recovery unit for receiving wasted ink discharged from said printing head to an area outside the printing article;

a flushing ink recovery unit located adjacent to said overflow ink recovery unit for receiving wasted ink involved in flushing; and a cartridge containing said printing article and removably mounted in a printer body, wherein said overflow ink recovery unit and said flushing ink recovery unit are disposed in said cartridge.

40. An ink jet printer having a function of flushing a printing head and capable of setting a print available region to a wider region than a printing article, characterized by comprising:

an overflow ink recovery unit for receiving wasted ink discharged from said printing head to an area outside the printing article;

a flushing ink recovery unit located adjacent to said overflow ink recovery unit for receiving wasted ink involved in flushing said overflow ink recovery unit and said flushing ink recovery unit being integrally formed; and a cartridge containing said printing article and removably mounted in a printer body, wherein said overflow ink recovery unit and said flushing ink recovery unit are disposed in said cartridge.

* * * * *